US009818382B2

(12) United States Patent
Rose

(10) Patent No.: US 9,818,382 B2
(45) **Date of Patent: *Nov. 14, 2017**

(54) TOP MOUNTED TREMOLO AND TUNING APPARATUS

(76) Inventor: Floyd D. Rose, Solana Beach, CA (US)

( * ) Notice: Subject to any disclaimer, the term of this patent is extended or adjusted under 35 U.S.C. 154(b) by 327 days.

This patent is subject to a terminal disclaimer.

(21) Appl. No.: 13/978,841

(22) PCT Filed: Jan. 11, 2012

(86) PCT No.: PCT/US2012/020978

§ 371 (c)(1),
(2), (4) Date: Jul. 9, 2013

(87) PCT Pub. No.: WO2012/097089

PCT Pub. Date: Jul. 19, 2012

(65) Prior Publication Data

US 2013/0291705 A1 Nov. 7, 2013

Related U.S. Application Data

(60) Provisional application No. 61/431,721, filed on Jan. 11, 2011, provisional application No. 61/432,839, filed on Jan. 14, 2011.

(51) Int. Cl.
*G10D 3/00* (2006.01)
*G10D 3/14* (2006.01)

(52) U.S. Cl.
CPC ..... *G10D 3/146* (2013.01); *Y10T 29/49574* (2015.01)

(58) Field of Classification Search
CPC ..... G10D 3/146
(Continued)

(56) References Cited

U.S. PATENT DOCUMENTS 2,741,146 A 4/1956 Fender
4,171,661 A 10/1979 Rose
(Continued)

FOREIGN PATENT DOCUMENTS

WO 2010103183 A1 9/2010
WO 2012097089 A2 7/2012

OTHER PUBLICATIONS

"2300 Series Modular Bridge Systems Specifications", Dec. 15, 2012.

(Continued)

*Primary Examiner* — Jianchun Qin
(74) *Attorney, Agent, or Firm* — Lerner, David, Littenberg, Krumholz & Mentlik, LLP

(57) ABSTRACT

A tremolo and tuning apparatus is provided for a stringed musical instrument having a body, a neck extending from the body, a nut on an end of the neck remote from the body, and a string extending over the neck. The string makes a first critical contact at a point on the nut of the instrument and a second critical contact at a point on the apparatus. The apparatus includes a mounting frame configured for mounting on the surface of the body, an attachment post secured to the body, a base plate pivotally mounted with respect to the attachment post and having a surface adapted to receive a force, a string mounting assembly mounted on the base plate for holding the string, and a resilient member assembly for engagement with the mounting frame outside the body of the instrument and supplying a force to the base plate surface.

34 Claims, 15 Drawing Sheets

(58) Field of Classification Search
USPC ..... 84/313, 297 R, 298
See application file for complete search history.

(56) References Cited

U.S. PATENT DOCUMENTS

| | | | | |
|---|---|---|---|---|
| 4,355,970 | A | 10/1982 | Kitagawa et al. | |
| 4,497,236 | A | 2/1985 | Rose | |
| 4,512,232 | A | 4/1985 | Schaller | |
| 4,535,670 | A | 8/1985 | Borisoff | |
| 4,555,970 | A | 12/1985 | Rose | |
| 4,608,904 | A | 9/1986 | Steinberger | |
| 4,611,523 | A | 9/1986 | McFarland | |
| 4,632,005 | A * | 12/1986 | Steinberger | G10D 3/146 84/297 S |
| 4,655,116 | A | 4/1987 | Matsui | |
| 4,696,218 | A | 9/1987 | Hoshino et al. | |
| 4,742,750 | A | 5/1988 | Storey | |
| 4,882,967 | A | 11/1989 | Rose | |
| 4,955,275 | A | 9/1990 | Gunn | |
| 4,967,631 | A | 11/1990 | Rose | |
| 5,088,384 | A | 2/1992 | Lonnemo | |
| 5,198,601 | A | 3/1993 | McCabe | |
| 5,392,680 | A | 2/1995 | Stets | |
| 5,410,936 | A | 5/1995 | Ellsworth et al. | |
| 5,515,761 | A * | 5/1996 | Sides | 84/313 |
| 5,522,299 | A | 6/1996 | Rose | |
| 5,537,907 | A | 7/1996 | Rose | |
| 5,539,143 | A | 7/1996 | Rose | |
| 5,589,653 | A | 12/1996 | Rose | |
| 5,684,256 | A | 11/1997 | Rose | |
| 5,689,075 | A | 11/1997 | Rose | |
| 5,696,335 | A | 12/1997 | Rose | |
| 5,700,965 | A | 12/1997 | Rose | |
| 5,705,760 | A | 1/1998 | Rose | |
| 5,717,150 | A | 2/1998 | Rose | |
| 5,783,763 | A | 7/1998 | Schaller et al. | |
| 5,959,224 | A | 9/1999 | McCune | |
| 5,965,831 | A | 10/1999 | McCabe | |
| 6,034,311 | A | 3/2000 | Fisher, IV | |
| 6,111,176 | A | 8/2000 | Rose | |
| 6,137,039 | A | 10/2000 | Rose | |
| 6,175,066 | B1 | 1/2001 | McCabe | |
| 6,194,645 | B1 | 2/2001 | Rose | |
| 6,891,094 | B2 | 5/2005 | McCabe | |
| 7,521,616 | B2 * | 4/2009 | Kahler | G10D 3/146 84/313 |
| 7,544,873 | B1 | 6/2009 | Stets | |
| 7,696,420 | B2 | 4/2010 | Thompson | |
| 7,772,470 | B1 | 8/2010 | Olsen | |
| 2001/0002570 | A1 | 6/2001 | McCabe | |
| 2003/0183062 | A1 | 10/2003 | Schryer | |
| 2005/0076767 | A1 | 4/2005 | McCabe | |
| 2005/0150348 | A1 * | 7/2005 | Ito | G10D 3/04 84/299 |

OTHER PUBLICATIONS

"Bigsby Vibratos: Bigsby Guitars & Vibratos—Official Website", 6 pages, <http://www.bigsby.com/vibe/products/vibratos/>, Dec. 6, 2011.

"Original Floyd Rose Made for Gibson Les Paul", <http://www.ioffer.com/i/Original-Floyd-Rose-Made-For-Gibson-Les-Paul-143628919>, 2011.

"SG G-400 LE Maestro Tremolo Review," http://www.ultimate-guitar.com/reviews/electric guitars/epiphone, Apr. 27, 2009.

"Stetsbar vibrato," Guitarist Magazine, pp. 141-142, Summer 2004.

Google Image Result for http://www.rareguitars.com/media files/prodct images, May 10, 2010.

International Search Report and Written Opinion for Application No. PCT/US2012/020978 dated Feb. 8, 2013.

Partial International Search Report dated Nov. 26, 2012 in International Patent Appl. No. PCT/US2012/020978.

Stetsbar Brochure, www.stetsbar.com, 2010.

* cited by examiner

TOP MOUNTED TREMOLO AND TUNING APPARATUS

CROSS-REFERENCE

The present application is a national phase entry under 35 U.S.C. §371 of International Application No. PCT/US2012/020978 filed Jan. 11, 2012, published in English, which claims priority from U.S. Provisional Patent Application No. 61/431,721, filed Jan. 11, 2011, and U.S. Provisional Patent Application No. 61/432,839, filed Jan. 14, 2011, all of which are incorporated herein by reference.

TECHNICAL FIELD

The present invention relates to a tremolo and tuning apparatus for stringed musical instruments, such as guitars, and various components thereof.

BACKGROUND ART

As is known to those skilled in the art of stringed musical instruments, the strings of the instrument extend between two critical contact points, typically provided on or at the nut of the instrument and on or at the bridge of the instrument. Typically, each of the strings also extends beyond at least one of the critical contact points where it is secured to a tuning peg or tuning machine provided on the instrument for adjusting the tension of the string. Similarly, the other end of the string is typically anchored at a point beyond the other critical contact point. On the other hand, in some stringed musical instruments, the ends of the strings are secured at or closely adjacent to one of the critical contact points.

As is also known in the art, the sounds produced by the strings may be affected by the harmonic and pitch tuning of the individual strings. The harmonic or string length tuning of the strings is commonly adjusted by altering the distance between the critical contact points at which the string contacts the bridge and nut elements of the instrument. The pitch or fine tuning of the strings is a result of the tension in the strings which is generally adjusted by rotation of the tuning pegs or machines that pull on a string to increase tension. In some instances, fine tuning adjustment screws or devices are provided for adjusting the string tension. Generally, each of the strings of a musical instrument are both pitch and harmonically tuned individually and independently of the other strings of the musical instrument.

Tremolo or vibrato devices for stringed musical instruments are also widely known. They are typically used to simultaneously and significantly either reduce or increase the tension on all strings of the musical instrument, thereby producing unusual tone variations or vibrato. Examples of tremolos are shown in U.S. Pat. No. 2,741,146 to Fender and U.S. Pat. Nos. 4,171,661, 4,497,236 and 4,967,631 to Floyd Rose, the inventor herein.

As described in the '236 patent, a typical tremolo device includes a base plate having a flange depending from and attached to the bottom thereof. The base plate has knife edges at the front corners or outer front sides that allow pivotal movement of the base plate about fulcrum supports mounted to the body of a guitar. More particularly, a base plate support mechanism, such as upstanding posts is provided on the guitar body and receives the knife edges on the base plate so that the base plate is pivotal about the upstanding posts. Further, a series of string attachment means are mounted on the base plate. In such a configuration, it is necessary that the strings be anchored at points in a plane above the level of the plane of the base plate in order to induce a torque about a fulcrum on the attachment points. A spring or plurality of springs in tension is attached at one end to the flange which extends below the base plate, and at the other end to a wall, often indirectly by way of a hook that is directly attached to the wall, of an elongated cavity necessarily carved below the surface of the guitar body, providing an opposing torque to counterbalance the torque produced by the strings when they are in tune, such that the tremolo device remains static until a tremolo arm attached to the base plate is forced in an up or down direction.

Such a configuration requires that the guitar be permanently modified by the user by carving out a large recess through the guitar to allow for the flange to fit therein and by carving out the elongated cavity surrounding each counterbalancing spring. Furthermore, GIBSON-style guitars, some of the most commonly used guitars in the industry, are notoriously difficult to retrofit with a fulcrum tremolo device to replace a tune-o-matic and stop-tail piece style bridge. For example, they require routing in order to provide the tuning stability provided by double-locking and fine tuning with a fulcrum about which to pivot, such as in the '661, '236, and '631 patents. Some manufacturers such as BIGSBY, MAESTRO, SCHALLER, KAHLER and STETSBAR have produced tremolos to retrofit to GIBSON-style guitars, but they are known to have reduced string travel and hence little pitch variance and also lose their pitch tuning upon return of the tremolo arm to its normal, rest position.

Tremolo devices created for attachment to a GIBSON guitar without modification and that purportedly return the guitar to its original pitch are described in U.S. Pat. Nos. 5,392,680 and 7,544,873 to Stets. These tremolo devices each offer a low-profile design in which a tremolo arm is attached to a pinion gear that meshes with a gear rack fixed to a moveable plate that rides on ball bearings. The moveable plate in each of such tremolo devices moves forward and backward. Each movement of the plate causes the attached springs to be in tension and hence pull the plate back to the original position upon release of the tremolo arm, whether it is raised or lowered.

Although such a tremolo apparatus has a low profile and is installed with little or no modification, the interface of the ball bearings on the moveable plate introduces unwanted sliding friction in the system. Additionally, the patents to Stets do not incorporate fine tuners nor double-locking in which each string is locked at the nut and at the bridge assembly. Consequently, they induce friction from sliding strings over the nut. For this reason, balancing of the guitar strings and opposing springs about a fulcrum in tandem with a double-locking feature is the best known solution for reducing friction in a tremolo.

Another device, previously produced by SCHALLER ELECTRONIC GmbH, for Floyd Rose, utilizes a set of springs in parallel attached at one end to a location on a base plate between a fulcrum of the device, formed by indentations on posts inserted into a mounting frame, and the body of the guitar. The other end of the device is attached to a string mounting assembly that is caused to move by a corresponding movement of a tremolo arm. In this manner, the springs provide a force to balance the force of the strings and maintain the device in a rest position until a force is applied to the tremolo arm to move the base plate. Although the device is known to use as many as ten (10) springs, the springs do not provide enough tension to counterbalance the force of the commonly used string sets.

It is also known in the prior art that the tremolo arm of a guitar is a straight or slightly curved shaft attached to a tremolo device through various mechanisms. One configuration for a tremolo arm, produced by SCHALLER ELECTRONIC GmbH, has a nut having a central axis oriented perpendicularly to the guitar body, slid onto the shaft of the tremolo arm. The tremolo arm is inserted into a bushing and the nut is subsequently threaded onto a threaded portion of the bushing. Such a configuration requires routing the instrument below the base plate in order for the arm to rotate in an downward or upward direction, i.e., toward or away from the guitar. Such a design also allows the tremolo arm to subtly rock in relation to the nut and bushing. In other words, this design has inherent but unwanted clearances to ensure the components fit together. In an alternative arrangement, the tremolo arm is threaded or snapped onto a mounting stud fixed to a base plate of the tremolo, such as those made by STETSBAR. In both arrangements, a number of components are necessary to attach the tremolo arm. In the case of the SCHALLER-type designs, the portion of the tremolo arm that is inserted into the bushing must be long enough to accommodate all of these components. This increased length requires routing in the body to provide clearance for the tremolo arm and is thus undesirable.

The present invention addresses at least certain of the shortcomings of the prior art. In particular, according to one aspect of the present invention, there is provided a low-profile tremolo. According to a further aspect of the present invention, there is provided a fine tuning, double-locking tremolo apparatus applying a fulcrum balance. In accordance with a still further aspect of the present invention, a tremolo apparatus is provided which includes an associated tremolo arm with a side mounted tension adjustment and attachment screw. As such, the present invention constitutes a further step toward an optimum tremolo and tuning apparatus for stringed musical instruments.

SUMMARY OF THE INVENTION

In accordance with one aspect of the present invention, there is provided a top surface-mounted, tremolo and tuning apparatus for modifying the pitch on a stringed musical instrument using low-friction components. The tremolo and tuning apparatus is for use with stringed musical instruments in which the strings make a first critical contact with the instrument at a point on or adjacent to the nut of the instrument and a second critical contact at a point on or adjacent to the bridge of the instrument. Due to the nature and arrangement of its components, this tremolo and tuning apparatus or device may be retrofitted to an existing instrument equipped with a tune-o-matic stop tail piece type bridge with no required modification to the bridge end of the guitar and only slight modification at the neck end to install the locking nut if this nut is desired, and is capable of providing a relatively low profile. In this low profile configuration, none of the components or features of the apparatus, except for the attachment bolts, lie beneath the top surface of the body of the guitar or other stringed musical instrument.

In this aspect of the invention, a mounting frame is adapted for incorporation into the stringed musical instrument, and more particularly, adapted for mounting to the top surface of the guitar or other stringed musical instrument. A tremolo base plate is arranged to pivot about mounting studs that may be attached to a surface of or a surface attached to the instrument, such as the mounting frame. There is provided at least one saddle assembly mounted on the tremolo base plate and adapted to hold the end of a string. A tremolo transfer rod engagement block is provided on the base plate and is adapted to receive one end of a transfer rod. A resilient member, such as a spring, is also provided which is configured to be engaged with the mounting frame, and preferably the base plate, outside the body of the instrument and acts to provide an opposing force to the transfer rod engagement block for counterbalancing the tension or force created by the strings. In a preferred embodiment, the force applied by the resilient member is a compressive force.

In accordance with another aspect of the present invention, the tremolo and tuning apparatus includes a base plate which pivots about a fulcrum on the mounting studs. To maintain a balance between the force of the strings and counterbalancing spring forces, the point at which the strings make a critical contact with the tremolo apparatus is preferably located above the elevation of the fulcrum provided by the mounting studs.

In accordance with a further aspect of the present invention, a spring acts on a transfer rod to hold the transfer rod against the transfer rod engagement block and provide an opposing force to the force provided by the strings. Preferably, the spring is held in compression when the forces on the tremolo apparatus are in equilibrium in order to provide a counterbalancing force acting on the transfer rod engagement block which opposes the force provided by the strings. Preferably, the transfer rod has a narrowed tip, and more preferably a pointed tip, and the transfer rod engagement block has a recessed area, and more preferably, a conical indentation adapted to receive the narrowed or pointed tip. In this manner, the friction among the components within the tremolo apparatus may be further reduced from that of devices known in the prior art. Thus, it is to be appreciated that the only frictional forces acting on the base plate in such a configuration are those caused by the interfaces of the knife-edges of the base plate with the mounting studs, the saddle assemblies with the strings, and the point of the transfer rod with the indent of the transfer rod engagement block.

In accordance with a still further aspect of the present invention, an intonation gross adjustment mechanism is provided which may be inserted into the rear of the mounting frame. The intonation gross adjustment mechanism may comprise a plurality of screws which engage the attachment bolts mounted to the mounting frame such that as the adjustment screws are inserted further into the mounting frame, the mounting frame will move longitudinally away (i.e., change the direction the strings extend) from the neck of the guitar. This movement of the mounting frame will have the effect of a gross adjustment of the harmonic tuning of the strings of the instrument because all of the critical contact points for the strings will move in tandem with the mounting frame and tremolo device.

In accordance with yet another aspect of the present invention, the top surface of the mounting frame is adapted to receive a tremolo stop screw. When the tremolo stop screw is threaded into the mounting frame at this position, rotation of the screw serves to raise or lower the tremolo stop screw to a set position. In this manner, the tremolo stop screw reduces the angle of travel of a rear portion of the base plate furthest from the mounting studs about the fulcrums of the mounting studs in the downward direction. In what is known as a full blocked setup, the tremolo and tuning apparatus is set to "block" all movement of the base plate toward the body and thus be in constant contact with the base plate until the tremolo and tuning apparatus is activated in the opposite upward direction. In contrast, the tremolo device is in what is known as a full "floating setup" when the tremolo stop screw is disengaged from the base plate allowing free movement of the base plate in either direction.

In accordance with yet a further aspect of the present invention, a tremolo and tuning apparatus is provided for use with a stringed musical instrument having strings which make a first critical contact with the instrument at a point on the nut of the instrument and a second critical contact at a point on the bridge of the instrument. In accordance with this aspect, a base plate is provided which has at least one aperture which has flanges on opposite sides. Such a base plate may be the one previously discussed herein. An arm which has a handle portion and an insert portion may be inserted into the at least one aperture. The insert portion may have a grooved section adapted to engage the flanges of the base plate. In such an arrangement, a tightening mechanism engages the grooved section of the insert portion of the arm in which case the arm has substantially no movement in a direction perpendicular to the plane of the at least one aperture. In an alternative arrangement of this aspect, such a tightening mechanism may be an adjustment screw adapted to engage the grooved section of the insert portion of the tremolo arm at a location substantially perpendicular to the insert portion. Tightening of the screw will increase the effort required to rotate the tremolo arm whereas loosening it will have the opposite effect.

In accordance with a still further aspect of the present invention, a mounting frame with an indentation may be adapted to receive one end of the tremolo arm allowing a greater rotation or pivoting of the tremolo device to which the tremolo arm is connected.

In accordance with yet another aspect of the present invention, a method is provided for retrofitting a stringed musical instrument having a body and a bridge mounted on a surface of the body. For such an instrument, a neck extends from the body and has a nut on an end remote from the body. At least one string extends over the neck in which that at least one string makes a first critical contact with the instrument at a point on the nut of the instrument and a second critical contact at a point on the bridge of the instrument. In one step of the method in accordance with this aspect, the bridge and a portion of the attachment hardware for mounting the bridge to the body is removed from contact with the body. In another step, a tremolo and tuning apparatus is provided. Such an apparatus has a mounting frame, at least one attachment post, a base plate having a surface adapted to receive a force, a resilient member assembly, and at least one string mounting assembly adapted to hold the at least one string. In another step, the mounting frame is mounted onto the surface of the body of the stringed musical instrument. In yet another step, the at least one attachment post is secured to the body of the stringed musical instrument. In a further step, the resilient member assembly is engaged with the mounting frame and the base plate outside the body of the instrument to supply a force to the surface of the base plate. In this configuration, the force serves to pivotally mount the base plate against the at least one attachment post. In a preferred embodiment, the resilient member assembly acts to supply a compressive force. In an additional step, the at least one string is attached to the at least one string mounting assembly mounted on the base plate.

In accordance with a still further aspect of the invention, a method is provided for retrofitting a stringed musical instrument. Such a stringed musical instrument has a body, a bridge mounted on a surface of the body, a neck extending from the body, a nut on an end of the neck remote from the body, and at least one string extending over the neck. The at least one string makes a first critical contact with the instrument at a point on the nut of the instrument and a second critical contact at a point on the bridge of the instrument. In one step of the method in accordance with this aspect, the bridge and a portion of the attachment hardware for mounting the bridge to the body is removed from contact with the body. In another step, a tremolo and tuning apparatus is provided. Such an apparatus has a mounting frame, at least one attachment post configured to be secured to the body of the instrument, a base plate pivotally mounted with respect to the at least one attachment post and having a surface adapted to receive a force, at least one string mounting assembly mounted on said base plate that is adapted to hold the at least one string, and a resilient member assembly configured for engagement with the mounting frame outside the body of the instrument and to supply a force, preferably a compressive force, to the surface of the base plate. In a further step, the mounting frame is mounted onto the surface of the body of the stringed musical instrument. In an additional step, the at least one string is attached to the at least one string mounting assembly mounted on the base plate.

BRIEF DESCRIPTION OF THE DRAWINGS

These and other features, aspects, and advantages of the present invention will become better understood with regard to the following description, appended claims, and accompanying drawings in which:

BEST MODE FOR CARRYING OUT INVENTION

In the Brief Summary of the Invention above, in the Detailed Description of a Preferred Embodiment of the Invention and the claims that follow, and in the accompanying drawings, reference is made to particular features of the present invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components.

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit or a range having no lower limit, depending upon the variable being defined). For example, "at most 4" means 4 or less than 4. When, in this specification, a range is given as "(a first number) to (a second number)" or "(a first number)–(a second number)," this means a range whose lower limit is the first number and whose upper limit is the second number. For example, 25 to 100 mm means a range whose lower limit is 25 mm, and whose upper limit is 100 mm.

Figure 1:
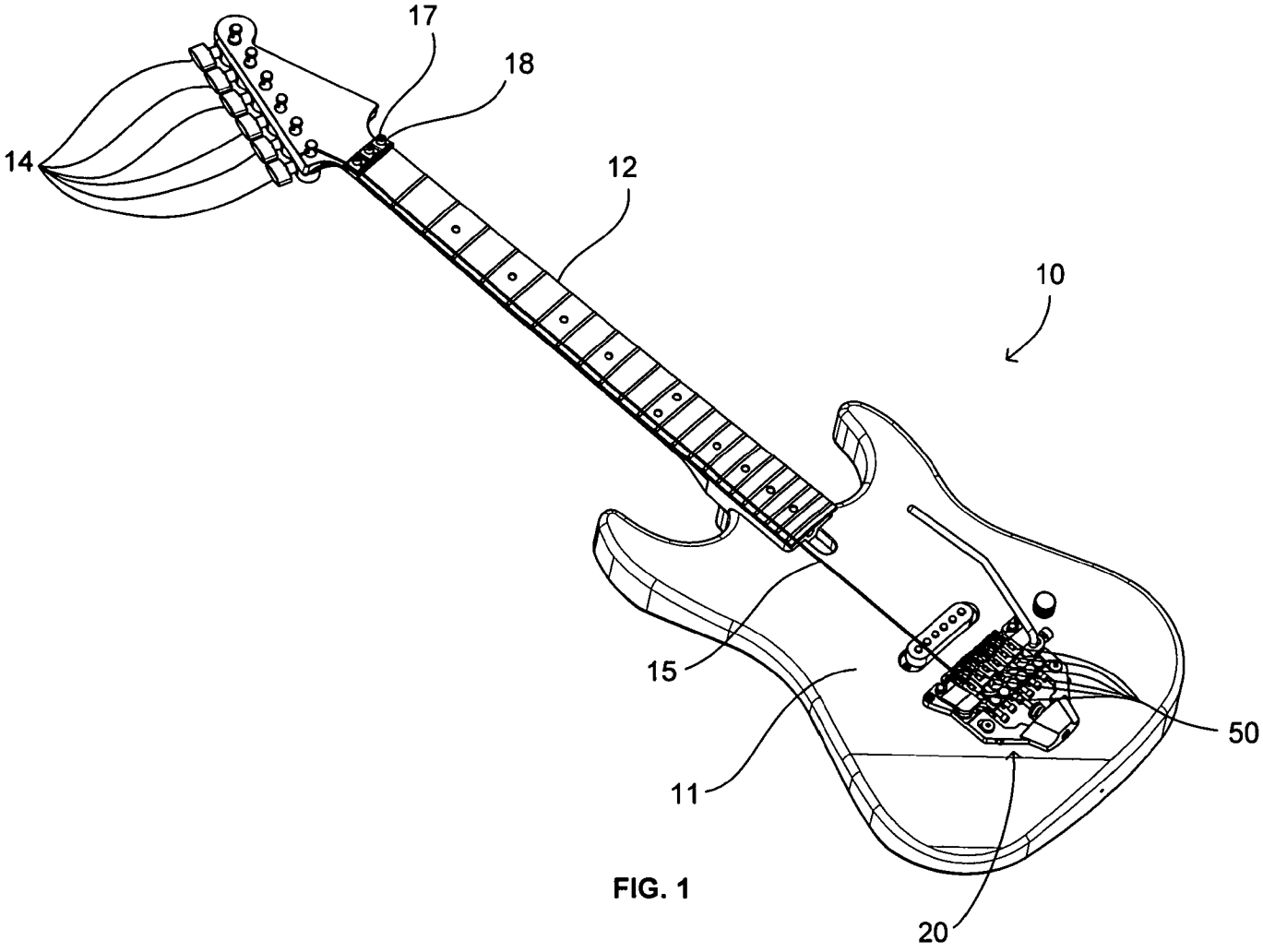
FIG. 1 is a perspective view showing the tremolo and tuning apparatus in accordance with an embodiment of the present invention mounted in position on an electric guitar type of stringed musical instrument.
Figure 2:
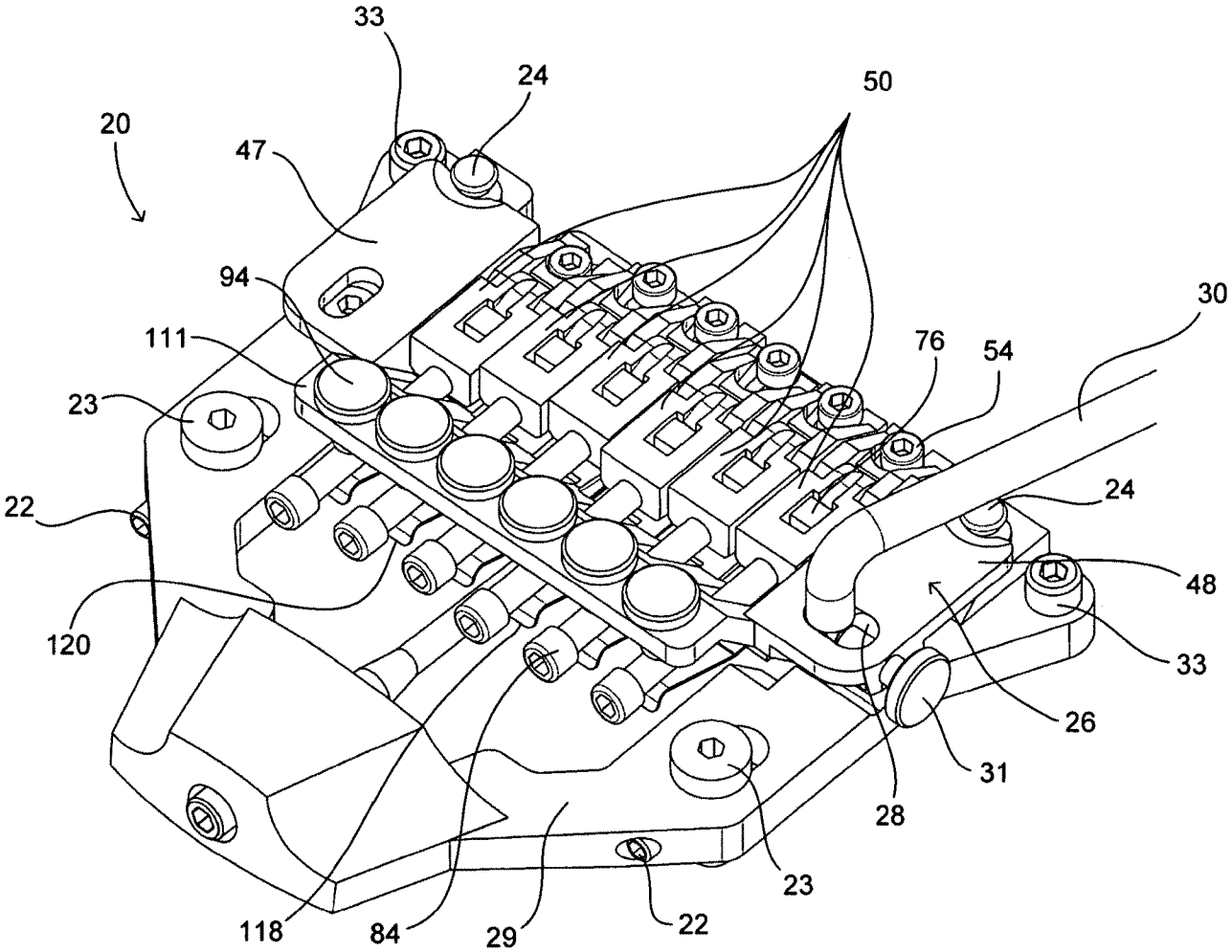
FIG. 2 is a perspective view showing the top of the tremolo and tuning apparatus in accordance with a preferred embodiment of the present invention.
Figure 3:
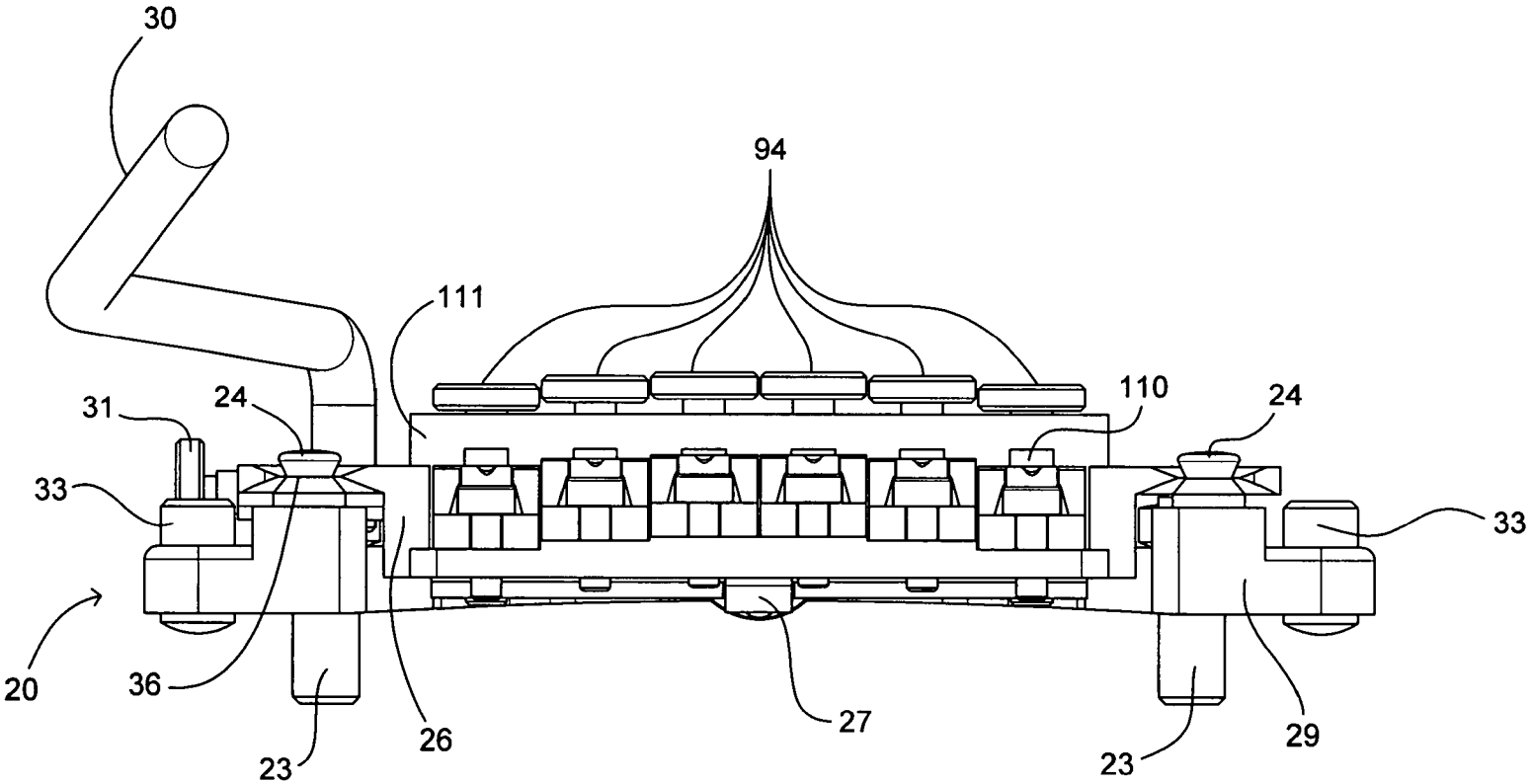
FIG. 3 is a front elevational view of the tremolo and tuning apparatus shown in FIG. 2.

Referring now to the drawings, FIG. 1 shows a guitar of a generally conventional design having a tremolo and tuning apparatus 20. The guitar 10 comprises generally a body and a neck 12. Near the top of the neck 12 is a nut element 18, and beyond that are several tuning pegs or machines 14, one for each string 15 of the guitar 10. The tremolo and tuning apparatus 20 in accordance with the present invention incorporates the function of a bridge element of a guitar as one part of a double-locking system for locking each string 15 through a set of saddle assemblies 50 as well as a tremolo apparatus for significantly increasing and/or decreasing the tension on all of the strings 15 of the guitar 10 simultaneously to produce unusual tone variations or sound effects. In this regard, a string clamping device 17 preferably is provided as a second part of the double-locking system in the vicinity of the nut 18 for securely holding or restraining the strings against movement relative to the nut 18.

Although the invention as shown in FIGS. 2-13 and described herein are intended generally for an electric guitar which does not require a cutout or routing of the body, such as a GIBSON Les Paul-style guitar, it should be understood that the invention can be used on other stringed musical instruments. The present invention will probably have its greatest use, however, on an electric guitar and hence it is so described.

As is well-known, each of the strings 15 of the guitar 10 makes contact with the guitar 10 at the nut 18 and at the respective bridge assembly 50, with the distance between the last contact point of the string 15 on the nut 18 (i.e., the contact point nearest the bridge) and the first contact point on the bridge assembly 50 (i.e., the contact point nearest the nut 18) defining the effective vibratory or harmonic length of the string during play. The contact points defining the effective vibratory string length may thus be referred to as the "critical" contact points for each string 15. As is also well-known, guitar strings 15 are both harmonically tuned and pitch tuned. Harmonic tuning of the strings 15 is accomplished by adjusting the distance between the critical contact points provided on the nut 18 and on the bridge assembly 50 of the guitar 10. For example, harmonic tuning may be accomplished by moving the critical contact point 59 of the string 15 on the bridge assembly 50 longitudinally relative to the critical contact point on the nut 18. Pitch tuning of the strings 15 is accomplished by changing the tension of the strings 15. Ideally, this should be accomplished without changing the distance between the nut and bridge critical contact points. Increasing the tension of the strings 15 raises the pitch of the string 15 while decreasing the tension of the string lowers the pitch of the string. Pitch tuning is generally accomplished through the use of tuning pegs or tuning machines 14 on the head of the guitar 10, and/or through the use of fine tuning adjustment members on the tremolo and tuning apparatus 20 or other types of bridge assemblies, as described more fully herein.

The tremolo and tuning apparatus 20 in accordance with the present invention employs generally the subject matter of U.S. Pat. Nos. 4,171,661, 4,497,236, and 4,967,631, the disclosures of which are hereby incorporated by reference herein. As shown in more detail with reference to FIGS. 2-7 and 13, the particular tremolo device 20 of the present invention comprises generally a tremolo base plate 26 having an indented tremolo transfer rod engagement block 27, and a compression spring assembly 44 arranged between the transfer rod engagement block 27 and the interior rear face of a tremolo mounting frame 29. The tremolo device may be mounted on a newly manufactured guitar substantially without any modifications to the existing guitar. The tremolo device 20 also includes a tremolo arm 30 secured to the base plate 26 near one of the side edges thereof.

Figure 6:
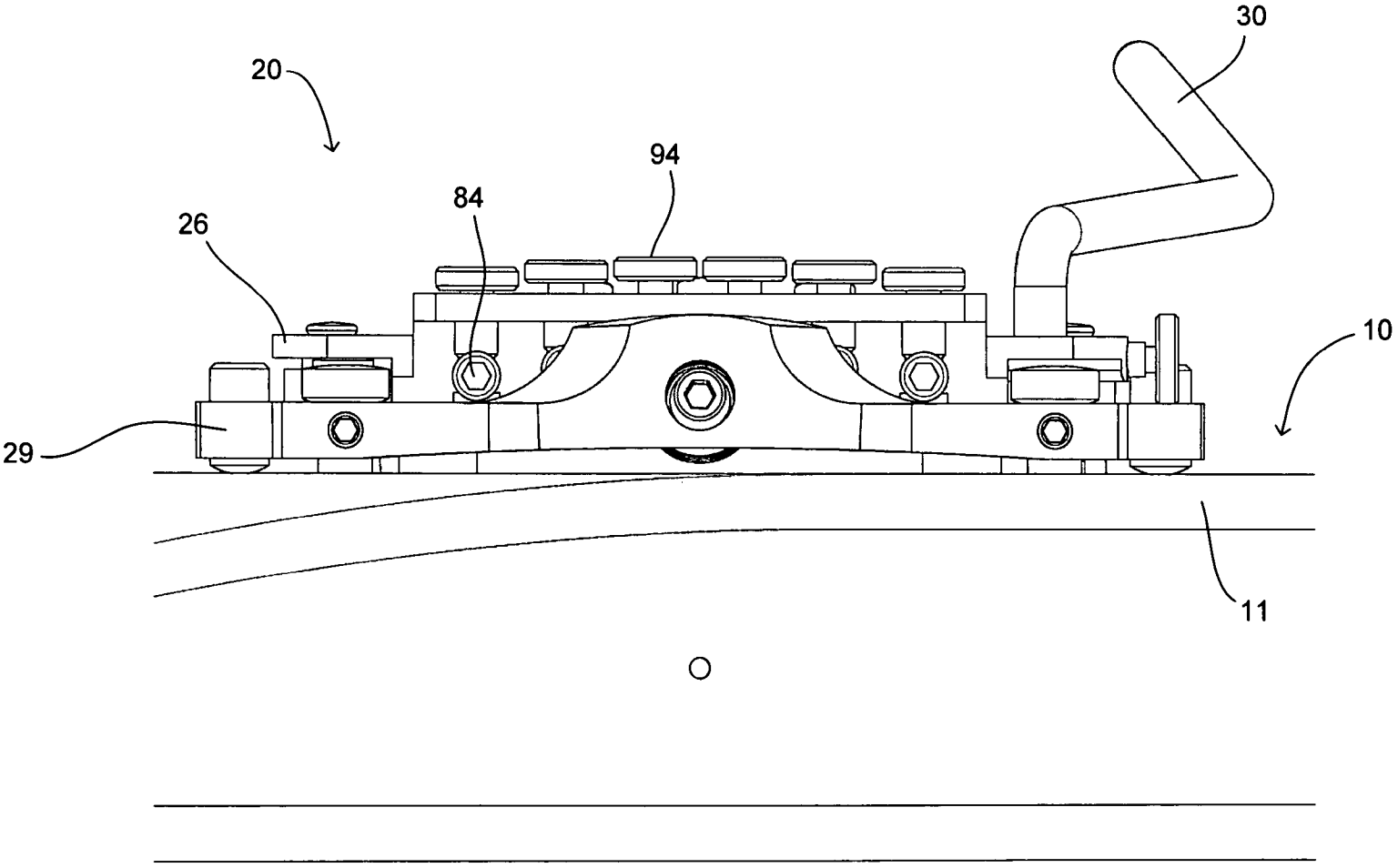
FIG. 6 is a rear elevational view of the tremolo and tuning apparatus shown in FIG. 2.

The views of the tremolo device 20 shown in FIGS. 2-6, 9, and 13 best illustrate the various features of the mounting frame 29. The mounting frame 29 forms the overall base of the tremolo device and, in a preferred embodiment, the frame is often a single body having two legs branching from a rear tailpiece section or portion towards the neck 12 of the guitar 10 and oriented predominantly in a plane parallel to the top surface of the body 11 of the guitar 10. As shown in FIG. 6, the rear or tailpiece section of the mounting frame 29 may be provided with a concave surface on the bottom of the rear tailpiece extending from one leg to the other so as to match the top surface of the body 11.

As best shown in FIGS. 1, 2, 3, and 9, mounting studs 24 having narrowly defined inner diameters or tapered notches along their shafts are attached to the forward inner corners of the mounting frame 29 on the tremolo device 20 so as to provide fulcrums 36 for pivoting of the tremolo device 20. The tremolo device 20 is adapted to be mounted on the guitar 10 by means of attachment bolts 23 which fix the body 11 of the guitar 10 to longitudinally oblong apertures on each leg of the mounting frame 29 so that the base plate 26 is generally aligned parallel to the top surface of the guitar 10 (see FIG. 9). Intonation gross adjustment screws 22 are threaded through bores provided in the rear of the mounting frame 29 and engage a grooved intermediate portion along the shaft of the attachment bolts 23. Rotation of the gross adjustment screws 22 causes movement of the screws in a direction generally parallel to the neck 12 of the guitar 10 and a corresponding longitudinal movement of the mounting frame 29, and thus tremolo device 20, relative to the body 11 of the guitar 10 in which the attachment bolts 23 fixed to the body are repositioned within the corresponding apertures on each leg of the mounting frame. The movement of the tremolo device 20 has the effect of a simultaneous and substantially equivalent adjustment of the critical contact points 59 of the strings 15 relative to the nut 18. In this regard, these screws provide a "gross" adjustment to the harmonic tuning of the strings 15. On the forward outside corners, and adjacent to the mounting studs 24, action adjustment screws 33 are threaded through the mounting frame 29 and, at an end thereof, engage the body 11 of the guitar 10. The adjustment screws 33 raise and lower the height of the front of the tremolo device 20 upon rotation in either direction of the screws. Such an adjustment causes the strings attached to each respective bridge assembly 50 to raise or lower depending on the rotation of the adjustment screws 33, leading to a change in what is known as the "action" of the guitar, or simply the height of the strings above the guitar.

As shown in FIGS. 1, 3, 7, and 9, the base plate 26 is pivotally mounted on the mounting frame 29. An indented tremolo transfer rod engagement block 27 extends in a generally perpendicular or downward direction from the base plate 26. In a preferred embodiment, the transfer rod engagement block 27 extends approximately 0.125" to 0.25" from the bottom surface of the base plate 26 and depending on desired conditions, it may extend more or less than these ranges. The transfer rod engagement block 27 may have a rounded surface, a rectangular front, or any other feasible shape on the side facing the neck 12 of the guitar 10 as in FIGS. 3 and 7. The opposite side of the transfer rod engagement block 27 preferably has a concave surface that comes to a generally narrowing, and more preferably a pointed, recess at its innermost region. In a preferred embodiment, the concave surface of the transfer rod engagement block 27 may be conical in shape and have an interior angle preferably on the order of 25° to 177°, and more preferably at most 170°.

In a preferred embodiment as shown in FIGS. 2, 3, 8, and 13, the base plate 26 has two raised platforms 47, 48 on opposite ends of the base plate 26, in which the platform 37 has an oblong opening 28 oriented in a direction perpendicular to the length of the guitar 10. The tremolo arm 30, briefly discussed previously herein, has a curved handle portion and an insert portion having a thinner grooved section 37 that may be inserted into the oblong opening 28 of the base plate 26. This opening 28 is chamfered on the top and bottom along one side portion or section, preferably along half of the opening 28, such that the end of the tremolo arm 30 can be inserted on the side portion or section without the chamfers and then slid into position. The grooved section 37 of the tremolo arm 30 is adapted to receive a tremolo arm adjustment screw 31 that enters the grooved section 37 at a direction substantially perpendicular to the insert portion of the arm 30 and forces the tremolo arm 30 towards the center of the base plate 26 where it engages the chamfers in the oblong opening 28. Once inserted in the desired position, a NYLOK patch is preferably provided to help maintain the arm adjustment screw 31 in that the desired position. Other mechanisms may be used to maintain the position of the screw 31, such as a spring held between the head of the screw and base plate, a set screw perpendicular to the adjustment screw, nylon tubing, a ball set within a detent between the base plate and adjustment screw, or other methods. When tightened, the arm adjustment screw 31 maintains the tremolo arm 30 in a fixed position about the central axis of the insert portion of the arm 30. Loosening the arm adjustment screw 31 allows the tremolo arm 30 to be rotated about the central axis of the insert portion of the tremolo arm 30. It should be noted that the chamfered portion may be tapered inwardly towards the center of the base plate such that it does not contact the end of the opening 28 nearest the center of the base plate 26. In this manner, the insert portion of the tremolo arm 30 is more prone to remain perpendicular to the oblong opening 28.

Figure 9:
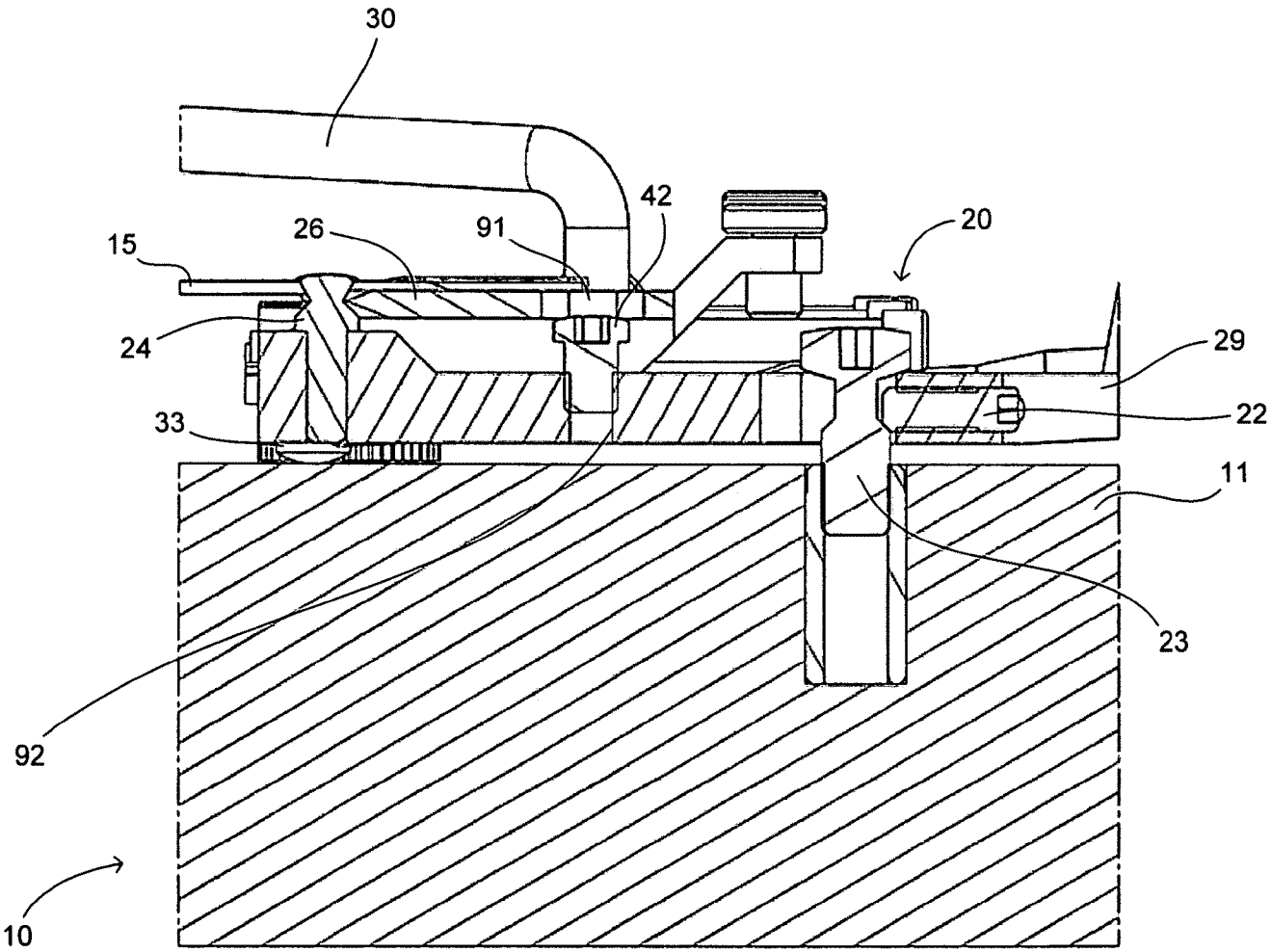
FIG. 9 is a cross-sectional view taken along lines 9-9 in FIG. 5.
Figure 13:
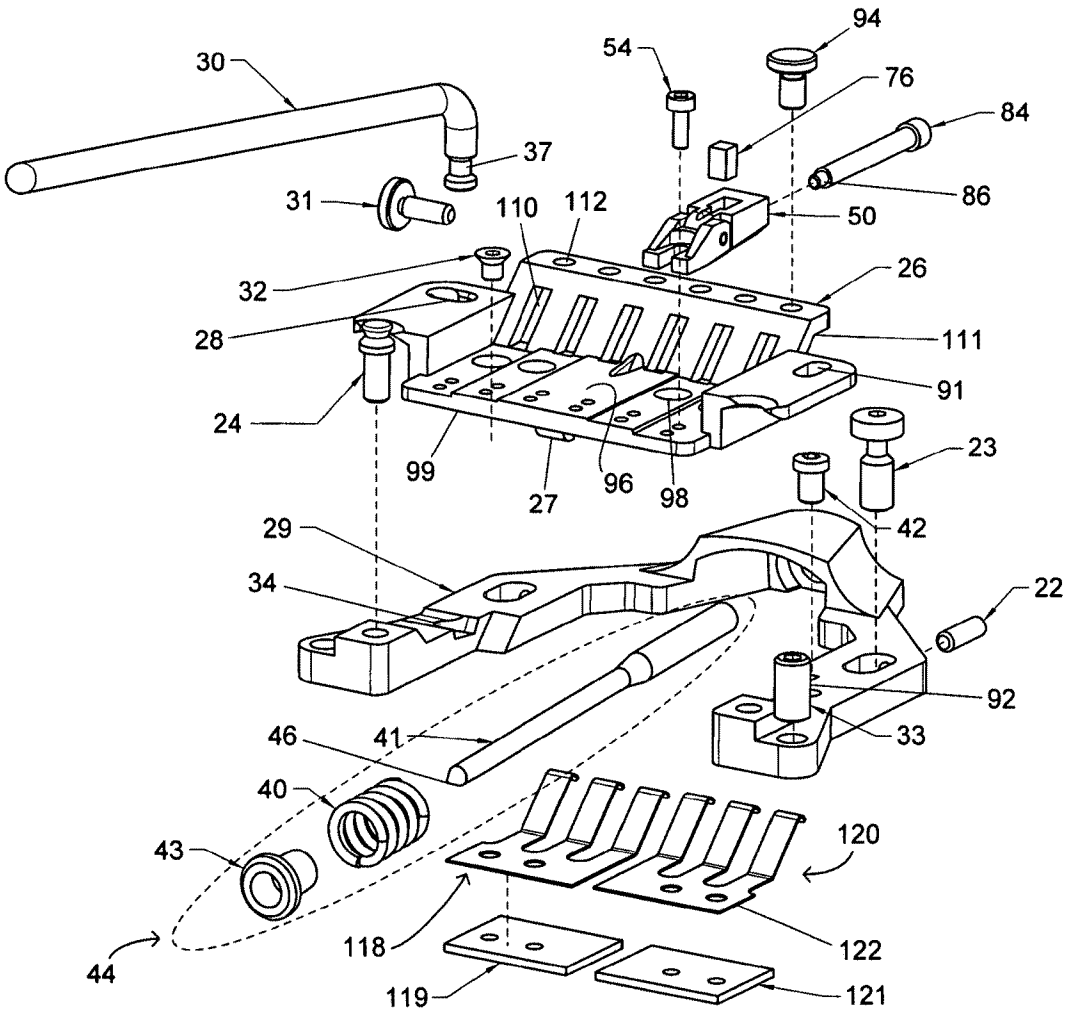
FIG. 13 is an exploded view of many of the components and features of the tremolo and tuning apparatus shown in FIGS. 2-12.

In accordance with FIGS. 9 and 13, the top surface of the mounting frame 29 has an opening 92 adapted to receive a tremolo stop screw 42 at a position that is in alignment with an aperture 91 in the base plate 26 that allows the passage of a tool, such as an Allen wrench, used to rotate the tremolo stop screw 42. In accordance with this aspect of the present invention, the flange or head of the screw 42 is larger than the aperture 91 in at least one direction. When the tremolo stop screw 42 is threaded into the mounting frame 29 at this position, rotation of the screw 42 raises or lowers the tremolo stop screw to a set position, limiting the amount of rotational travel of the base plate in the downward direction. In this manner, when in a full blocked setup (as described previously herein), the base plate 26 remains in constant contact with the tremolo stop screw 42 while the tremolo arm 30 remains in a static position. In a full floating setup (as also described previously herein), the tremolo stop screw 42 may be fully tightened down to the mounting frame 29 to allow free movement of the base plate 26 in either direction. Finally, in a limited floating setup, the base plate 26 may be rotated downward and thus the attached tremolo arm 30 may be rotated upward until the base plate 26 comes in contact with the tremolo stop screw 42. When in limited or full floating setups, the mounting frame 29 preferably has an indentation 34 which is adapted to receive the end of the tremolo arm 30 nearest to the base plate 26 as it is moved toward the body 11, allowing for greater rotation of the base plate 26 and the tremolo arm 30.

Figure 4:
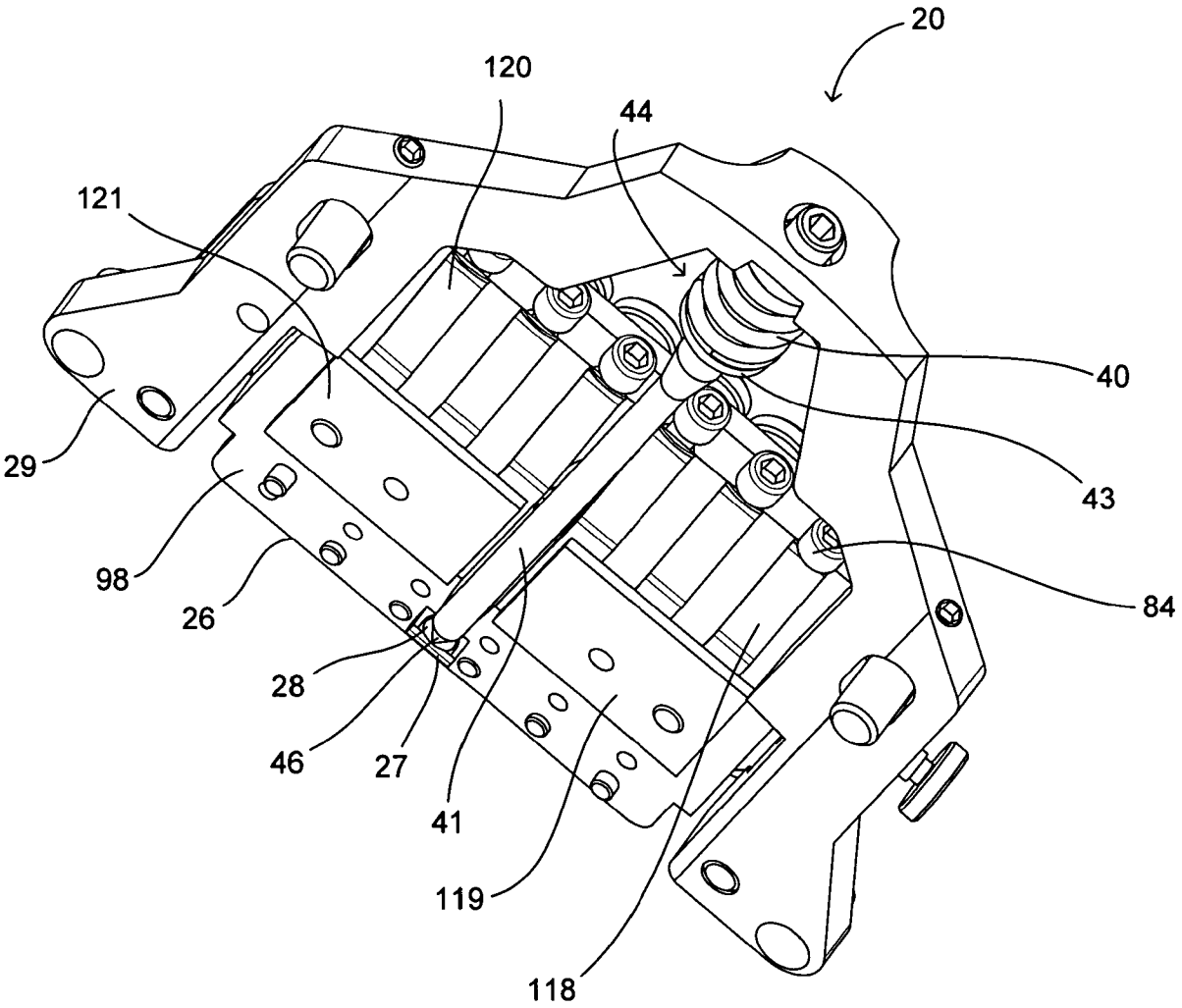
FIG. 4 is a perspective view showing the bottom of the tremolo and tuning apparatus shown in FIG. 2.
Figure 5:
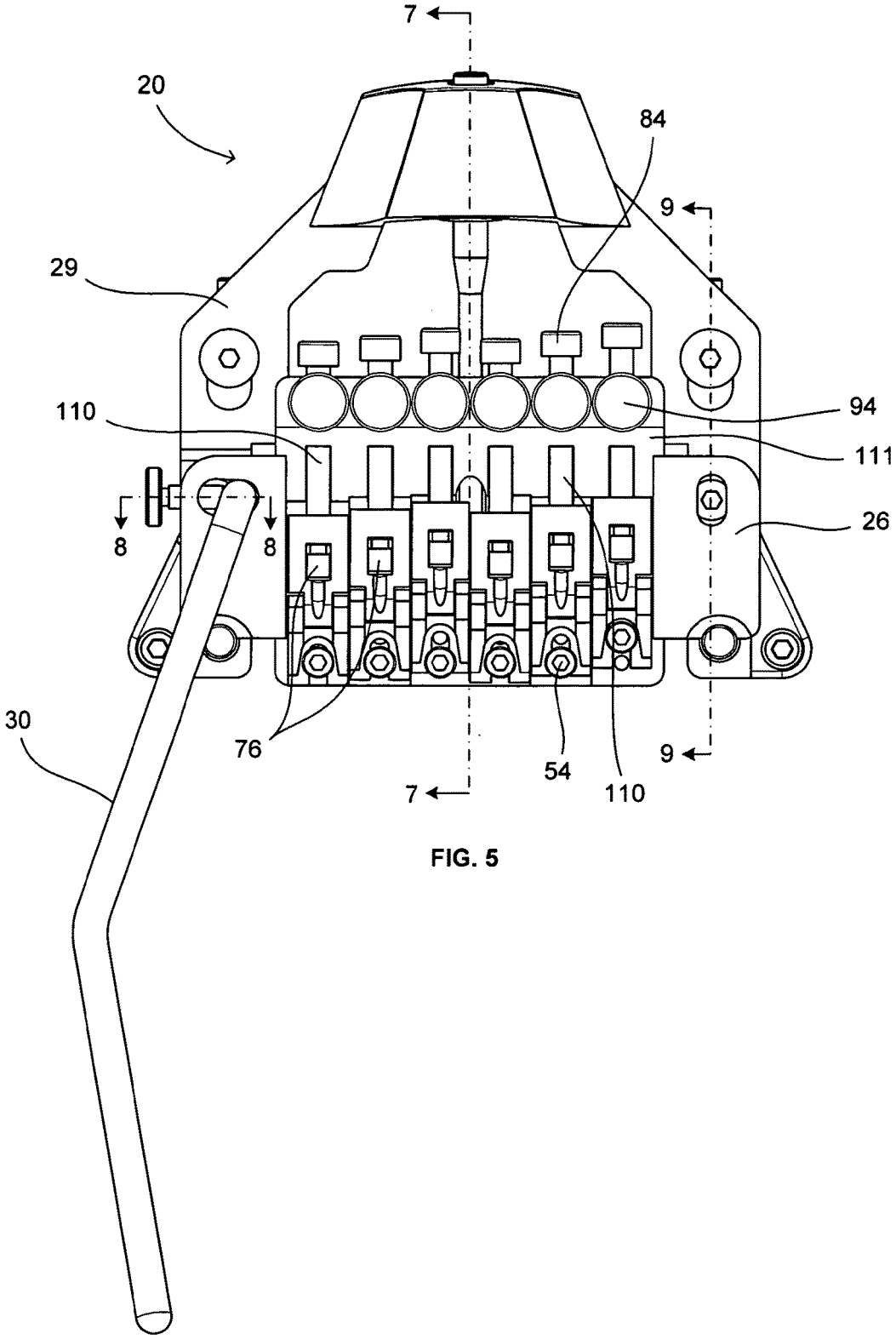
FIG. 5 is a plan view showing the top of the tremolo and tuning apparatus shown in FIG. 2.
Figure 7:
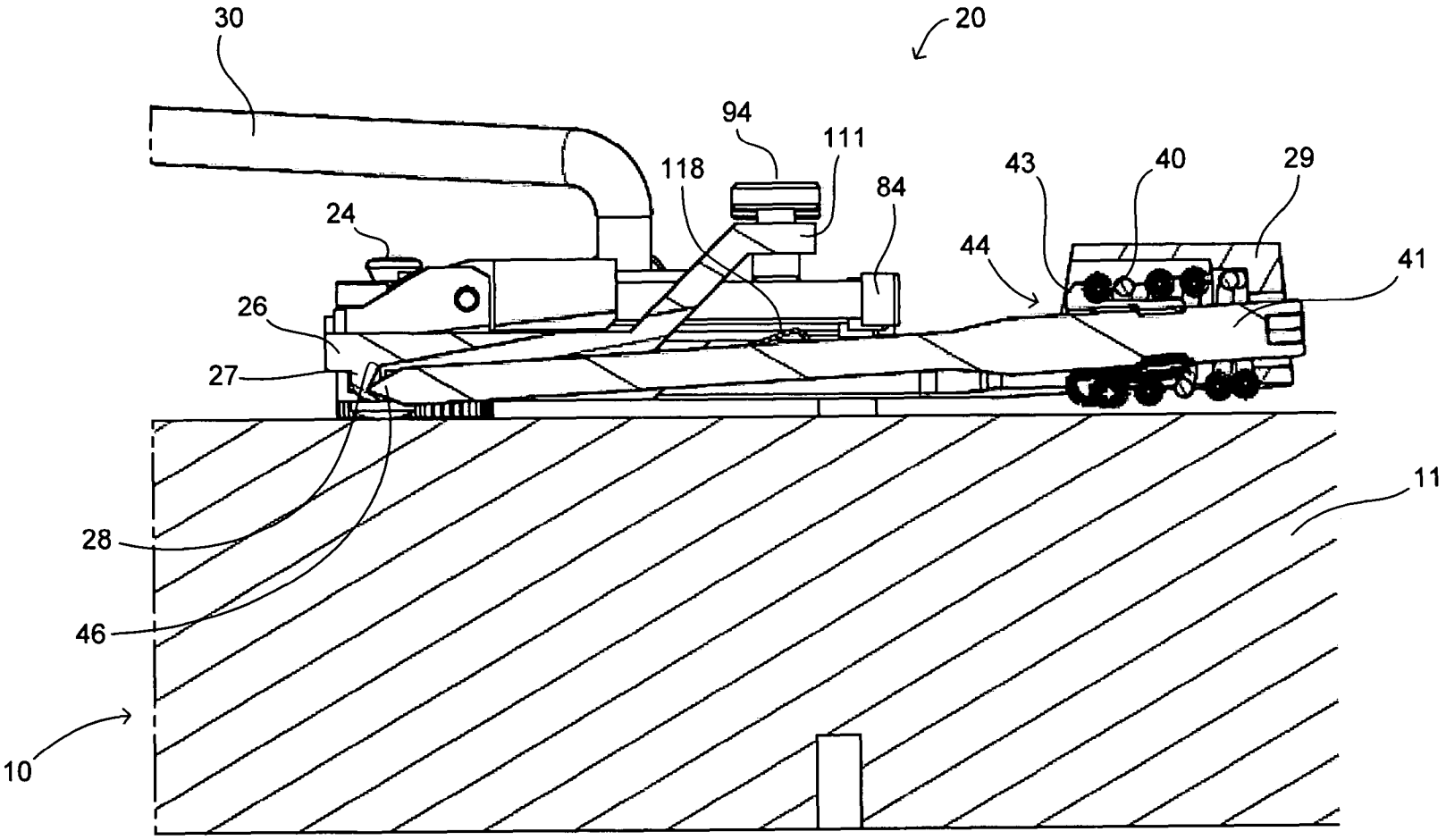
FIG. 7 is a cross-sectional view taken along lines 7-7 in FIG. 5.
Figure 8:
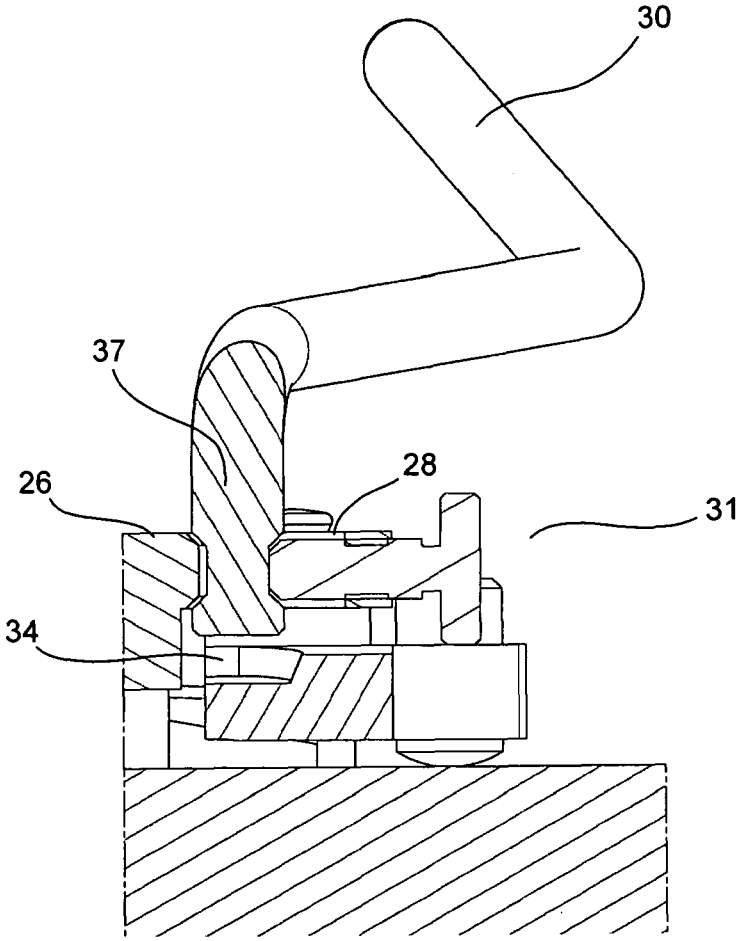
FIG. 8 is a cross-sectional view taken along lines 8-8 in FIG. 5.

As illustrated in FIGS. 4, 7, and 13 the compression spring assembly 44 may include a tremolo compression spring 40, a spring tension transfer rod 41, and a spring tension transfer bolt 43. In a preferred embodiment, the spring tension transfer rod 41 has a rear portion with a wider diameter that tapers to a front portion on the end of the rod 41 nearest the neck 12 of the guitar 10 concentric with the rear portion. The thinner diameter of the front portion allows for clearance to avoid contact with the base plate 26 and the saddle assemblies 50, in particular string lock screws 84, during movement of the rear of the base plate 26 away from the body 11 of the guitar 10. The maximum diameter of the spring tension transfer rod 41 is preferably set to fit within a hole through a rear of the tremolo mounting frame 29 such that the rod does not contact the mounting frame 29 during movement of the rod 41. The transfer bolt 43 has a portion with a wider or larger diameter and a concentric portion with a narrower or smaller diameter. These concentric portions of the transfer bolt 43 share the same inner diameter and have threads which engage the external threads on the first portion of the transfer rod 41 such that the transfer bolt 43 and the transfer rod 41 preferably are in threaded engagement with one another. More particularly, the transfer bolt 43 and the transfer rod 41 are in threaded engagement for approximately 1.0" to 1.5", and preferably for at least 1.0" along the first portion of the transfer rod 41. On one end, the compression spring 40 abuts a recess on the interior rear face of the tremolo mounting frame 29. The compression spring 40 has an inner diameter along the coil that surrounds the narrower portion of the transfer bolt 43 and a rear portion of the transfer rod 41 and abuts against the wider portion of the transfer bolt 43 on the other end with enough force such that upon rotation of the transfer rod 41, the transfer bolt 43 does not rotate. In this manner, rotating the transfer rod 41 either compresses or relaxes the compression spring 40 depending on the direction of rotation of the transfer rod 41. A tip 46 of the transfer rod 41 on the end nearest the neck 12 of the guitar 10 preferably is substantially conical and comes to a point that may be inserted into the indent 28 of the transfer rod engagement block 27 as shown in FIGS. 4 and 7, such that the contact between the tip 46 and the indent 28 of the transfer rod engagement block 27 is minimized, thereby producing the least amount of sliding friction between these components.

In this regard, it is preferable that the strings 15 and thus the critical contact point 59 (as described more fully herein) be placed at a desired height or distance which is above the horizontal plane passing through the fulcrums 36. That is, when taken perpendicularly from the base, the height of the strings 15 preferably is greater than the height of the fulcrums on the mounting studs 24. In a preferred embodiment shown in FIG. 3, the vertical distance from the critical contact point to a horizontal plane passing through the fulcrums 36 is preferably 0.300" to 0.450". The vertical distance from the critical contact point to the indent 28 of the transfer rod engagement block 27 is 0.025" to 0.200", and more preferably, approximately 0.140". As compression springs having various spring rates can be used depending on desired conditions, such as the amount of leverage desired, these distances may be smaller or greater. In this manner, when the tremolo arm 30 is moved toward the body 11 of the guitar 10, the tremolo base plate 26 pivots or tilts upwardly about the fulcrums 36 provided by the mounting studs 24.

Such movement causes the tremolo transfer rod engagement block 27 to rotate against the tip 46 of the transfer rod 41 which in turn acts against the compression spring 40. This action significantly changes the original pitch tune of the strings 15, in a flat direction by virtue of the tension in the strings 15 being reduced, and facilitates an increased range of sounds for the instrument 10. When the original pitch tune is again desired, the tremolo arm 30 is released and the compression spring 40 supplies a reaction force to return the tremolo base plate 26 to its original position, which returns the set of bridge assemblies 50 and the strings 15 to their original position. Similarly, when the tremolo arm 30 is moved away from the body 11 of the guitar 10, the base plate 26 pivots or tilts downwardly about the knife edge sections of the mounting studs 24, increasing the tension of the guitar strings 15 and, thus, changing the original pitch in a sharp direction. When the tremolo arm 30 is again released, the increased tension on the strings 15 returns the tremolo base plate 26 to its original neutral position, returning the set of bridge assemblies 50 and the strings 15 to their original position.

As best shown in FIGS. 4 and 7, the transfer rod engagement block 27 is preferably positioned such that, when the device 20 is placed on a guitar, the block 27 is closer to the neck of the guitar than the critical contact point of the strings. In alternative arrangements, the transfer rod engagement block could be moved in a direction away the neck of the guitar such that the block is located further from the neck than the critical contact points of the strings. However, as the block is moved further away from the neck, there is a critical location at which, during a rotation of the rear of the base plate away from the body of the guitar, the point of contact between the tip of the compression spring assembly and the indent of the transfer block is at a same distance above the body of the guitar as the critical contact point of the strings. When the point of contact is at that distance, the force provided by the compression spring assembly 44 against the transfer rod engagement block no longer provides a force to counterbalance the forces of the strings and instead provides a force that acts with the forces of the strings.

In an alternative embodiment, additional compression spring assemblies 44 may be used to supply an additional counterbalancing force against the transfer rod engagement block 27. In such an embodiment, each of the compression spring assemblies 44 preferably may have transfer rods 41 that may be inserted into the indent 28 of the transfer rod engagement block 27 on one end and that may extend through corresponding holes of a modified mounting frame on the other end. The diameters of the transfer rod 41 may be such that they avoid contact with the base plate 26 and the saddle assemblies 50 as described previously herein during activation of the tremolo device.

In accordance with one aspect of the present invention, individual saddle assemblies 50 are provided for each of the strings 15 of the guitar 10. As best seen with reference to FIGS. 10-12, the saddle assemblies 50 each include a rotatable string support member 52 which provides a string support area (generally 78, 80, 82 for the strings 15 and which, in a preferred embodiment, is mounted for rotation about an axis which extends transversely of the longitudinal direction of the strings 15. More particularly, in a preferred embodiment, the saddle assemblies 50 are each of a two-piece construction comprised of a first forward block element 56 and a second rear block element 52. The rear block element 52, which serves as the rotatable string support member and has the string support area thereon, is rotatably mounted to the forward block element 56.

The forward block element 56 includes a plate-like section 68 in the front and along the base thereof which has a slot 90 therein that extends rearwardly from the front edge thereof to approximately a point which is mid-width thereof. The slot 90 is wide enough to accommodate a saddle mounting screw or other securing device 54 which is threaded into the base plate 26 of the tremolo device 20 and which clamps the forward block element 56 against the base plate 26 (see FIGS. 2, 5, 10 and 11). Loosening of the machine screw 54 permits longitudinal movement of the forward block element 56 (together with its rear block element 52 and associated parts) for harmonic tuning of its respective string 15, as will be apparent from the description more fully hereinbelow.

The rear section of the forward block element 56 extends above the front plate-like section 68, but includes a cutout so that it is generally U-shaped when viewed from above and open in the rearward direction. The rear section thus comprises two side portions 58 joined at their forward ends by an intermediate portion 60.

The rear block element 52 has a body portion 64 which is generally of the same width as the forward block element 56, and a forward ear portion 66 which is adapted to be rotatably coupled to the front block element 56. The forward ear portion 66 is approximately of the same width as the distance between the two side portions 58 of the rear section of the forward block element 56 and is adapted to be disposed therebetween. Aligned circular openings are provided through the two side portions 58 as well as the ear portion 66 of the rear block element 52, and a pin 70 is positioned in such openings such that the rear block element 52 is rotatable relative to the forward block element 56 about the pin 70. In this regard, it will be appreciated that the pin 70 extends generally perpendicular to the longitudinal direction of the strings 15.

The top of the forward ear portion 66 of the rear block element 52 includes a central, generally longitudinally-extending, recessed trough 72. The body portion 64 of the rear block element 52 includes a central recess 74 therein for receiving a string lock insert block 76. The forward portion of the central recess 74 is adjacent to the rear portion of the recessed trough 72, extending downwardly in a substantially perpendicular direction to the base plate 26. The recessed trough 72 and central recess 74 provide a string contact support area 78, 80, 82 which, in the preferred embodiment, is substantially continuous from the point at which the string 15 contacts it and the point at which the string 15 is clamped. At the base of the central recess 74, there is provided a cover plate 89 used to prevent the insert block 76 from falling through the central recess 74 and also to prevent the string from contacting the base plate 26.

Figure 12:
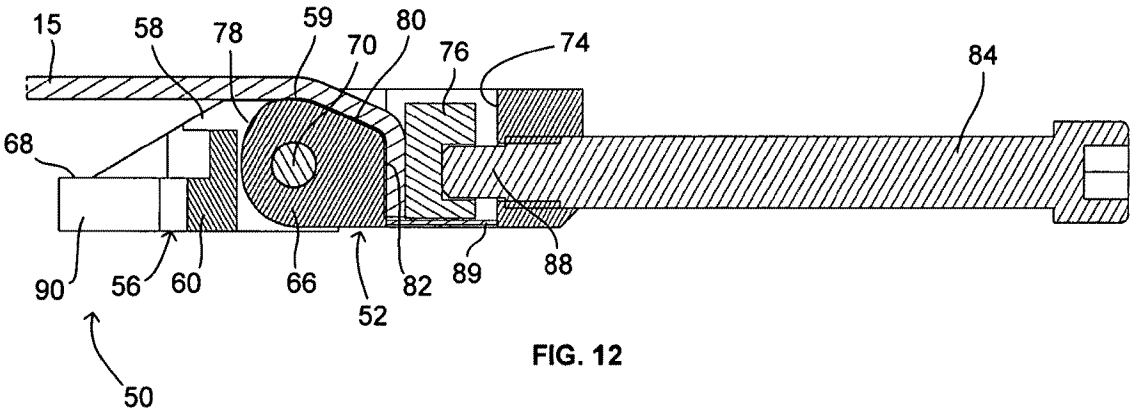
FIG. 12 is a cross-sectional view taken along lines 12-12 of FIG. 11.

As best seen in FIG. 12, the string contact or support area includes a forward string support portion 78 which includes the bridge critical contact point 59 for the string 15, a rearwardly sloping transition portion 80, and a vertically inclined string clamping portion 82. The forward string support portion 78 is curved and, at the intersection and along with the sloping transition portion 80, provides the initial or forwardmost contact of the saddle assembly 50 with the string 15. It will be appreciated that as the rear block element 52 is rotated (for purposes of fine tuning the string as more fully described below), the point at which the string 15 makes its initial contact with the forward string support portion 78 will change or shift on the rear block element 52; however, the distance between this point of initial contact, i.e., the bridge critical contact point 59, and the critical contact point on the nut 18 of the guitar 10 will remain essentially unchanged. In this regard, the radius of curvature of the forward string support portion 78 preferably is approximately equal to the distance from the forward string support portion 78 to the axis of rotation of the rear block element 52. Further, the forward string support portion preferably extends over a sufficient distance to provide a desired range of fine tuning, for instance, over an arc extending from about 30° to about 60°. Of course, the radius of curvature of the forward string support portion 78 and the distance it extends could be larger or smaller.

In a preferred embodiment, the rearwardly sloping transition portion 80 and the substantially vertically inclined string clamping portion 82 are arranged relative to one another so as to define an interior angle therebetween of 90 to 150°, and, more preferably, an angle of approximately 95 to 135°, and still more preferably at an angle of at most approximately 100 to 130°. For example, in the particular embodiment shown in FIG. 12, the rearwardly sloping transition portion is disposed at an interior angle of approximately 15 to 35°, and more preferably, approximately 20 to 30°, to the horizontal, and the downwardly-inclined string clamping portion 82 is at an angle of approximately 80 to 100°, and more preferably, approximately 88 to 92° to the vertical or simply vertical. For instance, the rearwardly sloping transition portion may be disposed at an angle of 20° to the horizontal, and the downwardly inclined clamping portion may be at an angle of approximately 0°.

As noted above, the central recess 74 includes a string lock insert block 76 arranged therein which is adapted to be urged toward the substantially vertically inclined string clamping portion or surface 82 for clamping the string 15 between the substantially vertically inclined surface 82 and the forward surface of the insert block 76. In this regard, the string lock screw 84 having a threaded region adjacent to the screw head engages the body portion 64 of the rear block element 52 in the rear and extends into the central recess 74. The string lock screw 84 has a tip 86 of reduced dimension which is received in a recess or indentation 88 provided in the rear surface of the insert block 76. Rotation of the lock screw 84 thus urges the insert block 76, which rests at the bottom surface of the recess 74, toward the substantially vertically inclined string clamping surface 82. It will be appreciated from FIG. 11 that the rear surface of the body portion 64 of the rear block element 52 is substantially perpendicular to the lock screw 84, matching the angle of the downward inclined string clamping surface 82. In a preferred embodiment, this angle of inclination is approximately 80 to 100°, and more preferably, approximately 88 to 92° to the vertical or simply vertical.

Figure 10:
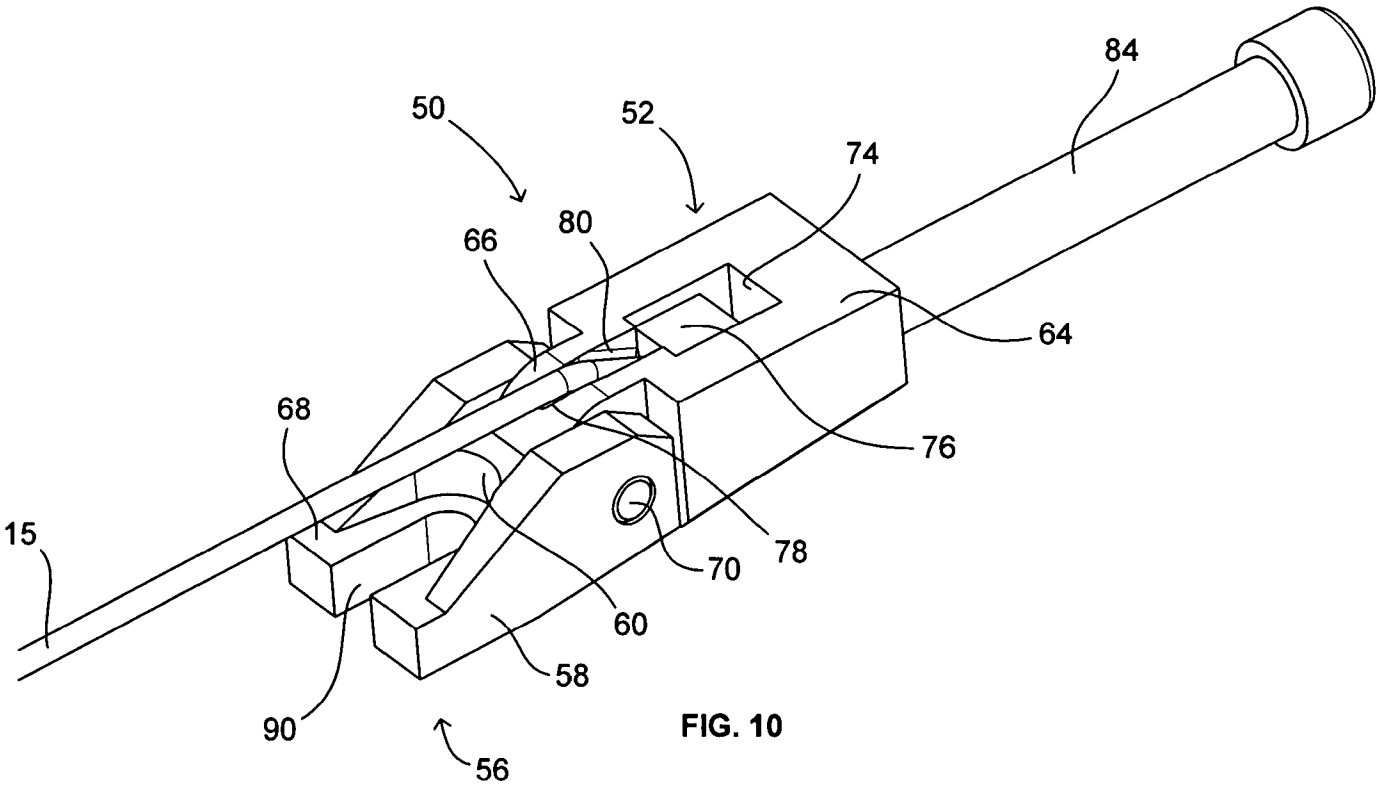
FIG. 10 is a perspective view of a saddle assembly employed in a preferred arrangement of the tremolo and tuning apparatus of the present invention, and also showing a string held thereby.
Figure 11:
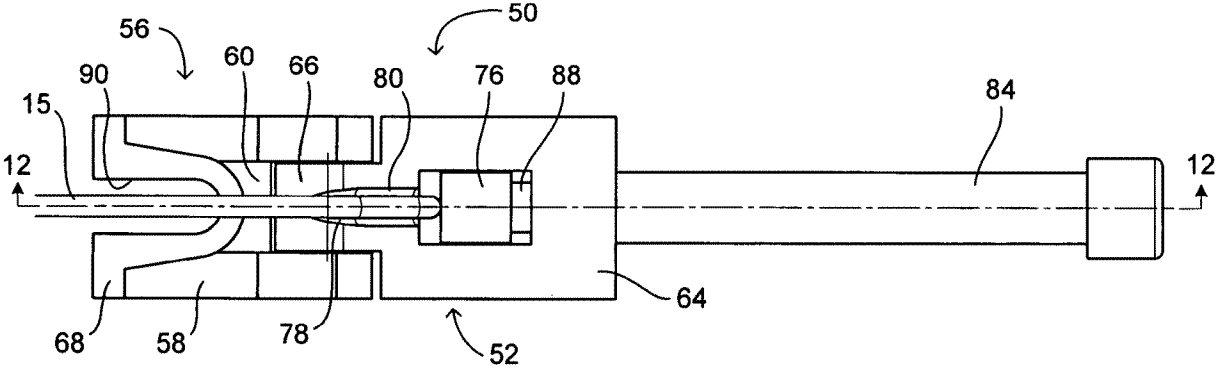
FIG. 11 is a plan view showing the top of the saddle assembly and the string held thereby shown in FIG. 10.

As can be seen from FIGS. 10-12, in order to clamp a string 15 to the rear block element 52, the lock screw 84 is first loosened and the end of the string (from which any ball or other enlarged head provided on the string has been cut or removed) is then urged downwardly between the string lock insert block 76 and the substantially vertically inclined surface 82 against the bottom of the central recess 74. The lock screw 84 is then tightened, and the string 15 is then arranged in the trough 72 so as to rest against the rearwardly sloping transition surface 80 and forward string support surface 78, and then passed forwardly over the neck 12 and nut 18 of the guitar 10 and threaded into the conventional tuning pegs or machines 14. As noted above, the string contact point on the saddle assembly 50 is provided on the forward string support portion 78 at the point where the string 15 leaves its contact with the trough 72. The string will then be both harmonic and pitch tuned as described more fully hereinbelow.

As shown in FIGS. 2, 4, 5-7, 10-12, and 13 a plurality of threaded bores 112 for receiving a plurality of threaded fine tuner adjustment members or screws 94 are provided on an elevated horizontal portion of a fine tuning support flange 111 that is integral with and located in the rear of the tremolo base plate 26. The support flange 111 extends upwardly from the rear edge of the tremolo base plate 26 at an interior angle of approximately 90° to about 150° relative to the top surface 96 of the base plate 26, and more preferably at an angle of 120 to 140°, and has a width that is somewhat greater than the distance between the two outside strings 15 on the instrument, i.e., the high E and low E strings, so that the support flange 111 is slightly wider than the set of strings. As a matter of reference, the rear block element 52 terminates a relatively short distance from where the support flange 111 begins to extend upwardly from base plate 26. The threaded bores 112 extend completely through the horizontal portion of the fine tuning support flange 111 and are aligned with elongated support flange slots 110. Threaded bores 112 further align with the lock screws 84 which extend outwardly from the insert block 76 and the rear surface of the body portion 64 of the rear block element 52 and through the support flange slots 110 to allow easy insertion of an Allen wrench into the head on the lock screws 84. As best seen in FIG. 7, the fine tuner screws 94 extend completely through the threaded bores 112 and are positioned to intersect with an unthreaded portion of the lock screws 84. Since this intersection occurs in an unthreaded region of the lock screws 84, the lock screws 84 can slide therealong during adjustment of the tension on the strings 15.

Referring again to FIGS. 2, 5 and 7, the longitudinal opening of the support flange slot 110 of the support flange 111 permits the lock screw 84 and hence rear block element 52 to move freely a short distance vertically. Lock screw 84 is biased vertically against the bottom of fine tuner screw 94 by the action of the tension of the instrument string 15 itself. The actual vertical position of lock screw 84 and hence the rotational position of rear block element 52 is determined by the position of fine tuner screw 94. Screw 94 may be conveniently rotated by hand. Threading screw 94 downwardly pushes lock screw 84 downwardly and rotates rear block element 52 towards the base plate 26. Threading screw 94 upwardly results in an upward movement of lock screw 84 and rotates rear block element 52 away from the base plate 26.

In a preferred embodiment, and as best seen in FIGS. 2, 4, 7, and 13, the tremolo device 20 is also provided with fine tuner tension springs, left 118 and right 120, for urging each of the string lock screws 84 upwardly against the respective fine tuner screws 94. In the preferred embodiment, the fine tuner tension springs 118, 120, can be mirror sets of leaf spring members or fingers that extend at an interior angle of approximately 90° to about 150° relative to a common web plate 122, and more preferably at an angle of 120 to 140° and are supported between the bottom surface 98 of the base plate 26 and fine tuner tension spring retainers, left 119 and right 121, through a threaded engagement provided by tension spring mounting screws 32. The bottom surface 98 of the base plate 26 has bores with tapered inner surfaces 99 upon which the tension spring mounting screws 32, whose threads protrude through the tapered bores 99 to engage the fine tuner tension springs 118, 120, may seat. Each of the fingers on the fine tuner tension springs 118, 120 may have a downwardly sloped section and an upwardly angled section that may engage the bottom of the string lock screws 84 in the area where these two sections meet. In this regard, the fine tuner tension springs 118, 120 provide an upwardly directed reaction force to ensure that the string lock screws 84 remain pressed against the fine tuner screws 94. As the string lock screws 84 are threaded within and thus engaged with the rear block elements 52 which hold the ends of the strings 15, the fine tuner tension springs 118, 120 also serve to maintain the rear block elements 52 in the desired lateral position, thus maintaining the proper lateral position of the strings 15. In this manner, possible detuning of the strings as the result of very slight changes in string tension due to any lateral misalignment is minimized.

It is to be appreciated that in accordance with the present invention, three forces act in tandem to maintain the fixed position of the tremolo device 20. The strings 15 pull the tremolo device 20 towards the neck 12 of the guitar 10, providing a first force, and the attachment bolts 23 provide a second opposing force, keeping the tremolo device 20 in a static position laterally. Then, when the strings 15 are held above the fulcrums of the mounting studs 24, the tension on the strings 15 creates a torque about a theoretical or imaginary axis that passes through the fulcrums 36 of the mounting studs 24 on the tremolo device 20 that is counterbalanced by an equal and opposite torque created by the third force of the compression spring 40 acting on the transfer rod engagement block 27 of the base plate 26. In other words, the fulcrums 36 on the mounting studs 24 are preferably placed at a position such that the torque created by the strings 15 pull on the saddle assemblies 50 and tending to cause rotation or pivoting of the base plate 26 in one direction is equal or approximately equal to the torque created by the compression spring 40 acting on the transfer rod engagement block 27 and tending to cause rotation or pivoting of the base plate 26 in the opposite direction.

It is further to be appreciated that the tremolo and tuning apparatus 20 of the present invention permits both harmonic and pitch tuning of the strings 15 of the musical instrument 10. More particularly, the harmonic tuning of a string 15 is set in a conventional manner by loosening of its respective saddle mounting screws 54 and adjusting the position of the forward block element 56 on the tremolo base plate 26. In this regard, as is well known, the harmonic tuning is governed by the distance between the critical contact point provided on the nut 18 of the guitar 10 and the critical contact point 59 provided on the saddle assembly 50 of the guitar, which in the tremolo device 20 of the present invention, is defined as the point at which the string makes its initial contact with the forward string support surface 78 of the rear block element 52. Once the harmonic distance is set, the strings 15 of the guitar 10 are then tuned in a conventional manner using the conventional machine heads 14. After being harmonically tuned and pitched tuned with the machine heads 14, the strings 15 are then locked at or in the vicinity of the nut 18 with the nut string clamp or locking device 17. This serves to isolate the string tension from the conventional tuning machine heads 14, and also prevents relative movement of the strings 15 over the nut 18 during actuation and subsequent release of the tremolo device 20 during play of the instrument 10. Fine adjustment of the pitch tuning of the strings 15 is thereafter accomplished with the fine tuner screws 94 provided on the tremolo device 20. Specifically, if the tension on a given string is to be changed, i.e., if the string is to be fine tuned, the fine tuner screw 94 is rotated clockwise (moving downwardly) to increase the string tension and hence string pitch, and counterclockwise (moving upwardly) to decrease the string tension and hence string pitch. As the rear block element 52 rotates about pin 70, the critical point of bridge contact of the string remains approximately at point 59, due to the radiused top portion, which consists of a single radius throughout a sufficient arc distance to accommodate the entire fine tuner range, of rear block element 52 and ear portion 66. Here it should be noted that the string lock insert block 76 serves to clamp the string 15 in close proximity to the critical contact point 59 provided on the forward string support surface 78.

Figure 14:
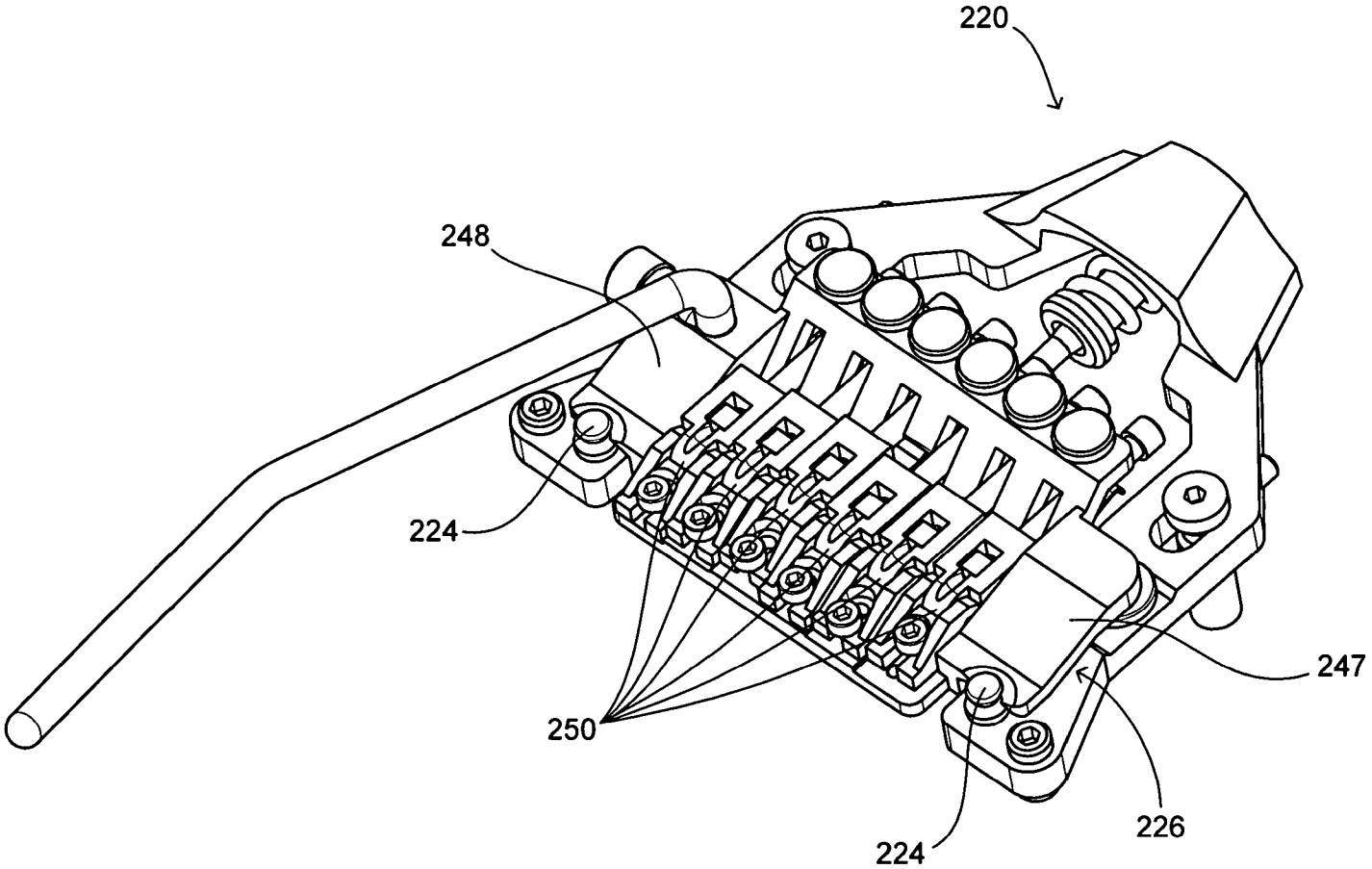
FIG. 14 is a perspective view showing the tremolo and tuning apparatus in accordance with another preferred embodiment the present invention.
Figure 15:
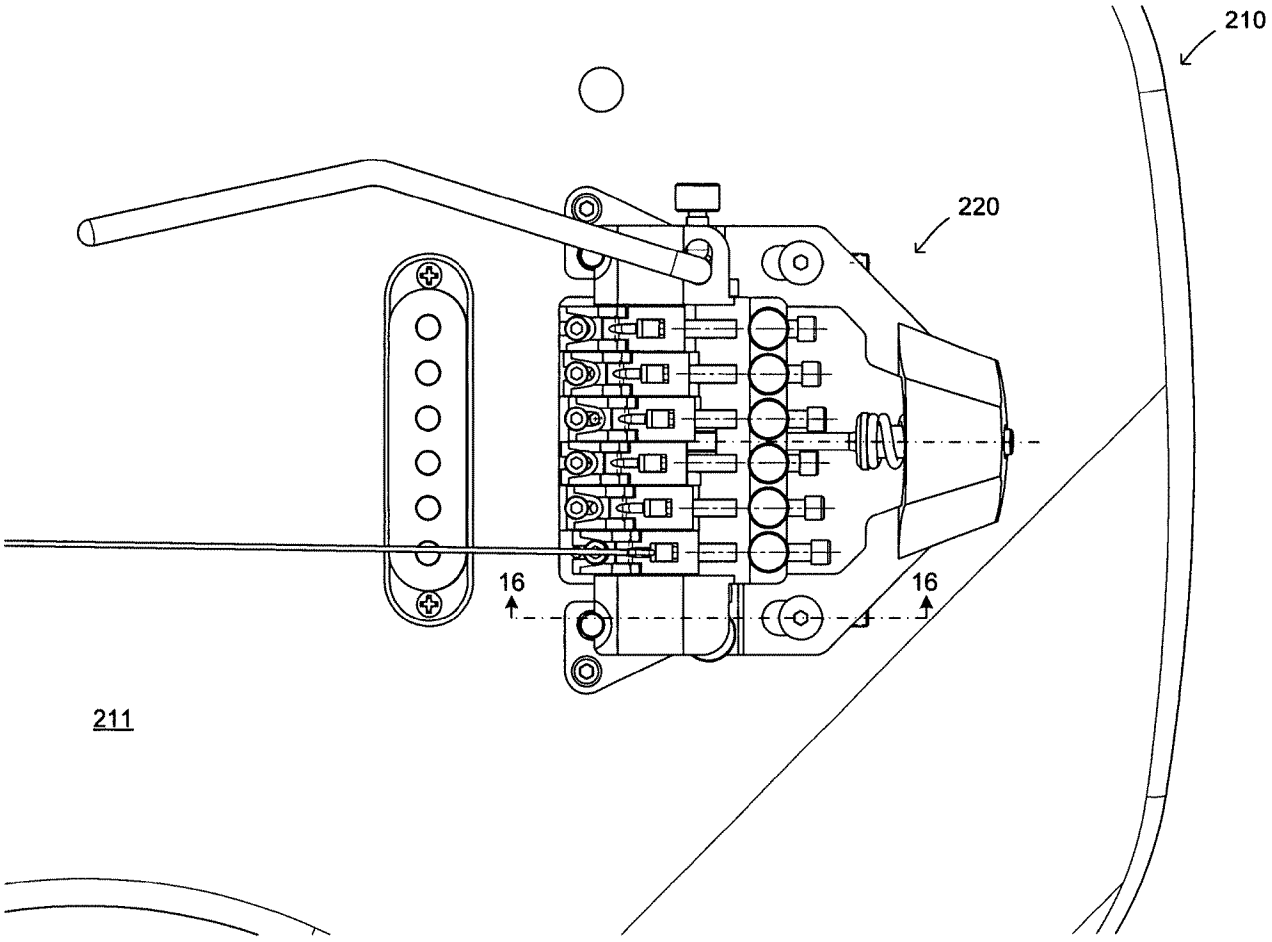
FIG. 15 is a plan view showing the tremolo and tuning apparatus of FIG. 14 mounted in position on an electric guitar type of stringed musical instrument.
Figure 16:
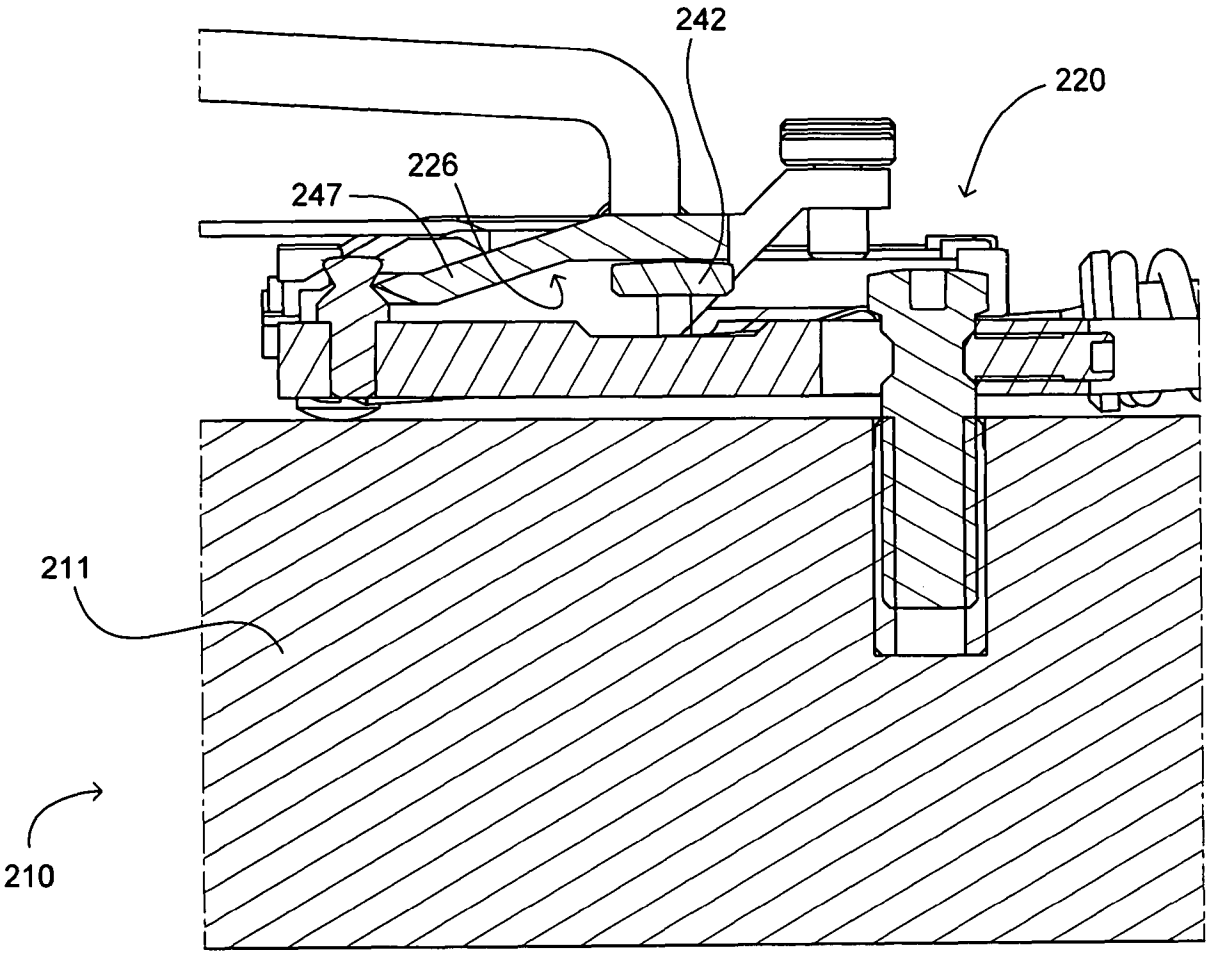
FIG. 16 is a cross-sectional view taken along lines 16-16 of FIG. 15.

In another preferred embodiment of the invention as shown in FIGS. 14-16, a tremolo and tuning device 220 is very similar in structure to the device 20 described previously herein. However, the device 220 has some notable differences. First, the device 220 has a base plate 226 having platforms 237, 238. Each of the platforms 237, 238 have a rear flat portion furthest from fulcrums 236 on mounting studs 224 of the device 220 that are raised above a horizontal plane passing through the fulcrums 236 and parallel to the surface on the body 211 of a guitar 210 to which the device 220 may be mounted. In this manner, the platforms 247, 248 provide clearance for a tremolo stop screw and for a tremolo arm as in the embodiment previously herein.

In this preferred embodiment, the fulcrums 236 are set at a distance below the critical contact point of strings that are properly assembled on the saddle assemblies 250 that is less than the comparable distance of the fulcrums 36 of the base plate 26 in the tremolo device 20 previously described. Due to this lower position of the fulcrums 236, each of the platforms further has a forward flat portion below the rear flat portion having knife edges that contact the fulcrums 236. The greater distances between the fulcrums and the critical contact points of the strings on the device 220 provide for a greater range of travel, and hence greater potential drop in pitch, for the device 220 during movement of a rear of the base plate 226 furthest from the fulcrums 236 in a direction away from the body 211 when mounted on the guitar 210 than the range of travel provided by the configuration of the device 20.

The device 220 further has a tremolo stop screw 242 that may be mounted into a mounting frame 229 in the same manner as the tremolo stop screw 42. In contrast to the device 20, the base plate 226 of the device 20 does not provide an aperture for passage of a tool therethrough. However, the tremolo stop screw 242 may be easily hand-tightened due to its radius that extends beyond an edge of the platform 247.

In summary, the top mounted tremolo and tuning apparatus just described may incorporate a number of features to overcome many of the obstacles not previously overcome in the prior art. First, the tremolo device provides a relatively low profile with respect to the body of the stringed instrument, while allowing for a spring with sufficient strength to properly provide a counterbalance for any combined string tension. Furthermore, the device may be top mounted onto the surface of the stringed instrument without any or at most with only minimal routing or cutting of a cavity within the instrument, while still maintaining a low profile and/or sufficient leverage provided by the force of the incorporated spring. The device may also provide features that add minimal additional friction between the moving elements of the device, such as a third fulcrum at the point where the spring that counterbalances the forces of the strings meets the transfer rod engagement block. Next, an aspect of the present invention incorporates a tremolo arm secured to a base plate by a tightening mechanism such as a side mounted adjustment screw that supplies a force against the tremolo arm making it possible to mount a very low profile tremolo arm that does not extend too far below the surface of the body of the instrument but still provides tension adjustment capability. Finally, the tremolo device may include an intonation gross adjustment mechanism that allows the mounting frame to move relative to the points at which the tremolo device attaches to an instrument, and thus simultaneously changes the effective length of the strings and grossly adjusts the harmonic tuning of the strings.

Although the invention herein has been described with reference to particular features, it is to be understood that these features are merely illustrative of the principles and applications of the present invention. It is therefore to be understood that numerous modifications, including changes in the sizes of the various features described herein, may be made to the illustrative embodiment and that other arrangements may be devised without departing from the spirit and scope of the present invention. In this regard, the present invention encompasses numerous additional features in addition to those specific features set forth in the appended claims.

The invention claimed is:

1. A tremolo and tuning apparatus for a stringed musical instrument having a body, a neck extending from the body, a nut on an end of the neck remote from the body, and at least one string extending over the neck, wherein a first portion of the at least one string makes a first critical contact with the instrument at a point on the nut of the instrument, and wherein the tremolo and tuning apparatus is operable to hold a second portion of the at least one string at a respective second critical contact, the apparatus comprising:

a mounting frame configured to be secured to a surface of the body of the stringed musical instrument, said mounting frame having a front end and a rear end which, when said mounting frame is secured to the surface of the body of the stringed musical instrument, is further from the neck of the stringed musical instrument than said front end, said mounting frame further having opposing legs and oblong apertures through the opposing legs, the oblong apertures being aligned in a direction parallel to the at least one string and being configured to receive respective attachment bolts;

at least one attachment post configured to be secured to the body of the instrument;

a base plate configured to be pivotally mounted against said at least one attachment post at a location adjacent said front end of said mounting frame and having a surface configured to receive a force;

at least one string mounting assembly carried by said base plate wherein said at least one string mounting assembly is configured to hold the at least one string;

a resilient member assembly configured to press against said mounting frame outside the body of the instrument when the mounting frame is secured to the surface of the body of the stringed musical instrument and to supply a force to said surface of said base plate to counter the force of the at least one string when the at least one string is held by the string mounting assembly carried by the base plate; and gross adjustment elements adjustably inserted into said mounting frame and configured for engagement with the respective attachment bolts when the attachment bolts are received in the oblong apertures such that a rotation of said gross adjustment elements causes a movement of said gross adjustment elements relative to said mounting frame and such that when said gross adjustment elements are in engagement with the attachment bolts, a rotation of said gross adjustment elements causes the attachment bolts to be repositioned in said oblong apertures of said mounting frame.

2. The tremolo and tuning apparatus of claim 1, wherein said at least one attachment post is mounted on (i) the body of the instrument or (ii) a second mounting frame mounted on the surface of the body of the instrument.

3. The tremolo and tuning apparatus of claim 1, wherein two attachment posts are secured to the body of the stringed musical instrument, and wherein said base plate is pivotally mounted with respect to each of said two attachment posts.

4. The tremolo and tuning apparatus of claim 1, wherein a tip of said resilient member assembly contacts said surface of said base plate.

5. The tremolo and tuning apparatus of claim 1, wherein said resilient member assembly includes a transfer rod configured at one end to press against a resilient element supplying a force against said mounting frame and at another end to press against said surface of said base plate, and wherein said resilient member assembly has a portion configured for avoiding contact with the base plate and string mounting assemblies during pivotal movement of the base plate.

6. The tremolo and tuning apparatus of claim 5, wherein a tip of said transfer rod of said resilient member assembly contacts said surface of said base plate, and wherein said surface of said base plate includes an indentation for receiving said tip of said transfer rod.

7. The tremolo and tuning apparatus of claim 1, wherein said force which said base plate is configured to receive is a compressive force.

8. The tremolo and tuning apparatus of claim 1, wherein said resilient member assembly includes a spring that supplies said force to said surface of said base plate.

9. The tremolo and tuning apparatus of claim 1, further comprising a tremolo stopping element adjustably mounted to said mounting frame and having a contact surface adapted to contact said base plate at a predetermined pivotal position of said base plate to prevent movement of said base plate to other predetermined pivotal positions.

10. The tremolo and tuning apparatus of claim 9, wherein said tremolo stopping element is a thumbscrew threadedly engaged with said mounting frame, said thumbscrew having a head including said contact surface.

11. The tremolo and tuning apparatus of claim 10, wherein said other predetermined pivotal positions are positions between said contact surface and said mounting frame.

12. The tremolo and tuning apparatus of claim 1, wherein the distance between said surface of said base plate and the nut is shorter than the distance between the second critical contact point and the nut.

13. The tremolo and tuning apparatus of claim 1, wherein the string mounting assembly has a locking mechanism adapted to securely hold the string in the vicinity of the second critical contact point.

14. The tremolo and tuning apparatus of claim 1, further comprising a tremolo stopping element adjustably mounted to at least one of (i) the body of the instrument, (ii) said mounting frame and (iii) a second mounting frame mounted on the surface of the body of the instrument, said tremolo stopping element further having a surface adapted to contact said base plate at a predetermined pivotal position of said base plate to prevent movement of said base plate to other predetermined pivotal positions.

15. A stringed musical instrument comprising:

a body having a surface;

a neck extending from said body;

a nut on an end of said neck remote from said body;

at least one string extending over said neck, said at least one string being substantially parallel with said surface of said body; and said tremolo and tuning apparatus of claim 1 secured to said surface of said body of said stringed musical instrument, wherein a first portion of said at least one string makes a first critical contact with the instrument at a point on said nut of the instrument, wherein said tremolo and tuning apparatus is operable to hold a second portion of said at least one string at a respective second critical contact, and wherein said surface of said base plate of said tremolo and tuning apparatus lies over said surface of said body.

16. The stringed musical instrument of claim 15, wherein said at least one attachment post is mounted on (i) the body of the instrument or (ii) a second mounting frame mounted on the surface of the body of the instrument.

17. The stringed musical instrument of claim 15, wherein two attachment posts are secured to said body of the instrument and said base plate is pivotally mounted with respect to each of said two attachment posts.

18. The stringed musical instrument of claim 15, wherein said tremolo and tuning apparatus further comprises:

attachment bolts adapted to mount said mounting frame to the instrument through said oblong apertures.

19. The tremolo and tuning apparatus of claim 15, wherein the at least one string is securely held by locking mechanisms in the vicinity of the first and second critical contact points.

20. The stringed musical instrument of claim 15, wherein said at least one attachment post is mounted on said mounting frame.

21. The tremolo and tuning apparatus of claim 1, wherein said base plate has at least one aperture, said at least one aperture passing through a platform in a first direction and having a first section with interior flanges and a second section without interior flanges, the tremolo and tuning apparatus further comprising:

an arm having a handle portion and an insert portion, wherein said insert portion has an end configured to fit into said second section of said aperture but not to fit into said first section of said at least one aperture of said base plate, and said insert portion has a grooved section intermediate of said end and said handle portion, said grooved section being configured to fit around the flanges of said second section of said at least one aperture of said base plate.

22. The tremolo and tuning apparatus of claim 1, wherein said at least one attachment post is mounted on said mounting frame.

23. The tremolo and tuning apparatus of claim 1, wherein the resilient member assembly is arranged between said mounting frame and said surface of said base plate, and wherein the resilient member assembly is further configured to supply a force to said mounting frame when the at least one string is held by the string mounting assembly carried by the base plate.

24. The tremolo and tuning apparatus of claim 1, wherein said resilient member assembly is configured to directly contact said mounting frame outside the body of the instrument when the mounting frame is secured to the surface of the body of the stringed musical instrument and to supply a force to said surface of said base plate to counter the force of the at least one string when the at least one string is held by the string mounting assembly carried by the base plate.

25. A tremolo and tuning apparatus for a stringed musical instrument having a body, a neck extending from the body, a nut on the end of the neck remote from the body, and at least one string extending over the neck, wherein a first portion of the at least one string makes a first critical contact with the instrument at a point on the nut of the instrument, and wherein the tremolo and tuning apparatus is operable to hold a second portion of the at least one string at a respective second critical contact, the apparatus comprising:

a mounting frame configured to be mounted on a surface of the body of the stringed musical instrument, said mounting frame having opposing legs and oblong apertures through the opposing legs, said oblong apertures being aligned in a direction parallel to the at least one string and being configured to receive respective attachment bolts;

at least one attachment post mounted on said mounting frame;

a base plate pivotally mounted with respect to said at least one attachment post so as to be pivotal about an axis extending in a direction transverse to the direction said at least one string extends and having a surface configured to receive a force;

at least one saddle assembly attached to said base plate and configured to hold the at least one string; and a spring located outside the body of the instrument when the mounting frame is mounted on the surface of the body of the stringed musical instrument, said spring being arranged between said mounting frame and said base plate; and a transfer rod, at least a portion of the transfer rod being arranged between said spring and said surface of said base plate such that said spring is configured to be compressed by said transfer rod and said mounting frame; and gross adjustment elements adjustably inserted into said mounting frame and configured for engagement with the respective attachment bolts when the attachment bolts are received in the oblong apertures such that a rotation of said gross adjustment elements causes a movement of said gross adjustment elements relative to said mounting frame and such that when said gross adjustment elements are in engagement with the attachment bolts, a rotation of said gross adjustment elements causes the attachment bolts to be repositioned in said oblong apertures of said mounting frame, wherein said transfer rod supplies a force to said surface of said base plate such that, when there are no external forces being applied to the tremolo and tuning apparatus and said mounting frame is mounted on the surface of the body of the instrument, said base plate is in a rest position wherein a first torque created by a force of the least one string acting on the at least one saddle assembly and a second torque created by said force supplied by said spring acting on said surface of said base plate are equal and counter each other.

26. A method for retrofitting a stringed musical instrument having a body, a bridge mounted on a surface of the body using hardware, a neck extending from the body, a nut on an end of the neck remote from the body, and at least one string extending over the neck, wherein the at least one string makes a first critical contact with the instrument at a point on the nut of the instrument and a second critical contact at a point on the bridge of the instrument, the method comprising:

removing the bridge and a portion of the hardware for mounting the bridge to the body from contact with a surface of the body;

mounting a mounting frame of a tremolo and tuning apparatus onto the surface of the body of the stringed musical instrument with attachment bolts, said attachment bolts being received through respective oblong apertures extending through respective opposing legs of said mounting frame, the respective oblong apertures being aligned in a direction parallel to the at least one string;

securing at least one attachment post to the body of the stringed musical instrument;

engaging a resilient member assembly of the tremolo and tuning apparatus with said mounting frame and a base plate of the tremolo and tuning apparatus having a surface, the surface of said base plate being outside and lying over the surface of the body of the stringed musical instrument when the mounting frame is mounted on the surface of the body of the stringed musical instrument, such that the resilient member assembly supplies a force to said surface of said base plate, said force pivotally mounting the base plate against the at least one attachment post;

attaching at least one string to at least one string mounting assembly carried by said base plate such that the at least one string counters the force supplied by the resilient member assembly to said surface of said base plate; and adjusting gross adjustment elements inserted into said mounting frame, said gross adjustment elements being configured for engagement with said respective attachment bolts such that a rotation of said gross adjustment elements causes a movement of said gross adjustment elements relative to said mounting frame and such that when said gross adjustment elements are in engagement with the attachment bolts, a rotation of said gross adjustment elements causes the attachment bolts to be repositioned in said oblong apertures of said mounting frame.

27. The method for retrofitting a stringed musical instrument of claim 26, wherein said force which said resilient element supplies to said base plate is a compressive force.

28. The method for retrofitting a stringed musical instrument of claim 26, wherein said base plate is mounted against two attachment posts when said force is supplied by said resilient element.

29. The method for retrofitting a stringed musical instrument of claim 26, further comprising mounting said at least one string mounting assembly to said base plate.

30. The method of retrofitting a stringed musical instrument of claim 26, wherein the engaging step comprises arranging said resilient member assembly between said mounting frame and said base plate.

31. The method for retrofitting a stringed musical instrument of claim 26, wherein said engaging step comprises pressing said resilient member assembly against said mounting frame outside the body of the instrument.

32. A tremolo and tuning apparatus for a stringed musical instrument having a body, a neck extending from the body, a nut on an end of the neck remote from the body, and at least one string extending over the neck, wherein a first portion of the at least one string makes a first critical contact with the instrument at a point on the nut of the instrument, and wherein the tuning apparatus is operable to hold a second portion of the at least one string at a respective second critical contact, the apparatus comprising:

a mounting frame configured to be mounted on the surface of the body of the stringed musical instrument and having a plurality of oblong apertures;

at least one attachment post configured to be secured to the body of the instrument;

a base plate configured to be pivotally mounted with respect to said at least one attachment post and having a surface configured to receive a force;

at least one string mounting assembly carried by said base plate wherein said at least one string mounting assembly is configured to hold the at least one string;

a resilient member assembly configured to be engaged with said mounting frame when the mounting frame is secured to the surface of the body of the stringed musical instrument and to supply a force to said surface of said base plate to counter the force of the at least one string when the at least one string is held by the string mounting assembly carried by the base plate;

attachment bolts adapted to mount said mounting frame to the instrument through said oblong apertures; and gross adjustment elements adjustably inserted into said mounting frame and configured for engagement with said attachment bolts such that a rotation of said gross adjustment elements causes a movement thereof relative to said mounting frame such that when said gross adjustment elements are in engagement with said attachment bolts, a rotation of said gross adjustment elements causes said attachment bolts to be repositioned in said oblong apertures of said mounting frame.

33. A tremolo and tuning apparatus for a stringed musical instrument having a body, a neck extending from the body, a nut on an end of the neck remote from the body, and at least one string extending over the neck, wherein a first portion of the at least one string makes a first critical contact with the instrument at a point on the nut of the instrument, and wherein the tremolo and tuning apparatus is operable to hold a second portion of the at least one string at a respective second critical contact, the apparatus comprising:

a mounting frame configured to be secured to a surface of the body of the stringed musical instrument, said mounting frame having a front end and a rear end which, when said mounting frame is secured to the surface of the body of the stringed musical instrument, is further from the neck of the stringed musical instrument than said front end;

at least one attachment post configured to be secured to the body of the instrument;

a base plate configured to be pivotally mounted against said at least one attachment post at a location adjacent said front end of said mounting frame and having a surface configured to receive a force, said base plate having at least one aperture, said at least one aperture passing through a platform in a first direction and having a first section with interior flanges and a second section without interior flanges;

at least one string mounting assembly carried by said base plate wherein said at least one string mounting assembly is configured to hold the at least one string;

a resilient member assembly configured to press against said mounting frame outside the body of the instrument when the mounting frame is secured to the surface of the body of the stringed musical instrument and to supply a force to said surface of said base plate to counter the force of the at least one string when the at least one string is held by the string mounting assembly carried by the base plate; and an arm having a handle portion and an insert portion, wherein said insert portion has an end configured to fit into said second section of said aperture but not to fit into said first section of said at least one aperture of said base plate, and said insert portion has a grooved section intermediate of said end and said handle portion, said grooved section being configured to fit around the flanges of said second section of said at least one aperture of said base plate.

34. The tremolo and tuning apparatus of claim 33, further comprising a tightening mechanism that engages said arm at said grooved section of the insert portion of the arm, wherein said tightening mechanism is rotatable from a first position to a second position such that said arm is more difficult to rotate when said tightening mechanism is in the second position than when said tightening mechanism is in the first position.

* * * * *